United States Patent [19]

Jacobs et al.

[11] 4,121,707

[45] Oct. 24, 1978

[54] SATELLITE VENDING MACHINE

[75] Inventors: Philip F. Jacobs; Evelyn Friedman; Peter Southall, all of Whitehall, N.Y.; Cyrus A. Alldred, Sherrills Ford; Frank M. Kecseti, Winston-Salem, both of N.C.

[73] Assignee: E. B. Metal & Rubber Industries, Inc., Whitehall, N.Y.

[21] Appl. No.: 771,377

[22] Filed: Feb. 23, 1977

[30] Foreign Application Priority Data

Mar. 2, 1976 [SE] Sweden ..... 7602950

[51] Int. Cl.[2] ..... G07F 5/16

[52] U.S. Cl. ..... 194/10

[58] Field of Search ..... 194/10, 9, 9 T; 221/130, 131, 197, 198

[56] References Cited

U.S. PATENT DOCUMENTS 3,128,013 4/1964 Holstein et al. ..... 221/197 X

*Primary Examiner*—Stanley H. Tollberg

[57] ABSTRACT

The invention relates to an article dispensing satellite vending machine which has no coin slots for coin deposits or coin operated mechanism but which is capable of being interconnected with another vending machine having a coin mechanism and an article dispensing mechanism which may dispense articles other than those dispensed by the satellite unit. The satellite machine includes a frame housed in a cabinet which is attached to the cabinet of the other vending machine, an article storing assembly being carried on the frame for storing articles to be dispensed. Ejectors are provided in the satellite unit for ejecting articles from compartments in the assembly, the ejectors in the satellite vending machine being interconnected with the coin mechanism in the other machine for enabling movement of the ejectors in the satellite machine under control of the coin mechanism in the other machine and for clearing the coin mechanism incident to movement of the ejectors whereby to dispense articles from the satellite unit as a function of coin deposit in the other machine. The satellite vending machine is adapted for interconnection with electrically, mechanically or electromechanically operated vending machines.

30 Claims, 19 Drawing Figures

SATELLITE VENDING MACHINE

BACKGROUND OF THE INVENTION

This invention generally relates to an article vending machine which contains articles to be dispensed but has no coin apparatus for dispensing such articles. The invention relates more specifically to a satellite vending machine which is connected to another vending machine having a coin apparatus to enable purchases to be made from the satellite machine as a function of coin deposit in the other machine.

There are many different kinds of machines for vending articles. Generally, such machines are designed to vend specific types of articles, as for example, packages of cigarettes. While these machines permit some latitude in accommodating different size cigarette packages, they are nevertheless limited in their design to accept the more conventional sizes. For example, presently available machines cannot accommodate 120 mm cigarettes because their magazines have been designed to accept packages for smaller size cigarettes. The design of new magazines with larger size compartments to accommodate, for example, 120 mm cigarettes means the loss of sales of the smaller size cigarette packages or if redesigned to accommodate both the larger 120 mm and the smaller 100 mm and regular sizes means reduced sales of each type. Accordingly, rather than expanding the sale of cigarettes, this expedient would surely curtail it. Moreover other problems are necessarily entailed in operating a vending machine with packages of widely varying size. For example, the size of the ejector heads of ejectors on which the stacks of the cigarette packages sit would have to be increased for correspondence to the package size, else jamming of the packages may occur due to tilting.

One solution to the problem of accommodating articles of diverse size is of course to make a separate vending machine which will accommodate the larger sizes. This, however, means the use of a second independent and fully equipped machine; i.e. having its own cancellation or clearing shaft and coin mechanism for mechanical machines and its own motor, coin mechanism and price board etc. for electrical machines which not only increases the cost of installation but also takes up valuable space since such separate machine will necessarily be located proximate the other machine.

SUMMARY OF THE INVENTION

With the foregoing in mind, we provide in accordance with the invention a combination of a first vending machine with a second vending machine having a cabinet and therewithin a coin mechanism, the first vending machine comprising a frame within a cabinet attached to the cabinet of the second machine, an article storing assembly carried by the frame and defining a plurality of compartments for storing articles to be dispensed, ejector means for ejecting articles from the compartments, and means operatively interconnecting the ejector means in the first machine with the coin mechanism in the second machine for enabling movement of the ejector means in the first machine under control of the coin mechanism in the second machine and for clearing the coin mechanism incident to movement of the ejector means whereby to dispense articles from the first machine as a function of the coin deposit in the second machine.

The first machine comprising the satellite machine of the invention, may be interconnected with an electrically, mechanically or electromechanically operated vending machine as will be clear from the disclosure to follow.

Because the satellite vending machine may be positioned on top of the second machine rather than standing side by side, it is clear that a substantial saving in space is obtained. Moreover because the satellite machine uses the coin mechanism and other basic components of the second machine it is evident that the cost of the satellite machine is minimal compared to that of a fully complemented machine.

The invention also concerns a satellite machine connected with a basic vending machine having a cabinet provided with slot means for receiving coins and within the cabinet a coin mechanism, operated by coins deposited within the coin slot means, a manually, selectively operable, article dispensing mechanism being provided in the basic machine for dispensing stored articles therefrom. The satellite machine, in turn, comprises a cabinet attached to the cabinet of the basic machine, a frame within and attached to the satellite machine cabinet, an article storing assembly carried by the frame and defining a plurality of compartments for storing articles to be dispensed, ejector means for ejecting articles from the compartments, and means for connecting the ejector means in the satelite machine with the coin and article dispensing mechanism in the second vending machine for (a) enabling movement of the ejector means in the satellite machine,
(b) for locking out the article dispensing mechanism of the basic machine when an ejector means in the satellite machine is operated, and
(c) for clearing said coin mechanism for subsequent coin deposits.

The satellite machine of the invention may be used with basic machines having only one tier of, for example, packages of cigarettes with a plurality of side-by-side columns permitting the purchaser to select a particular brand. The satellite unit may also be used with basic machines having two tiers, an upper and a lower and, as previously noted, of electrically, mechanically or electromechanically operated type.

Mechanically operated machines generally have at least one rotary cancellation shaft which must be rotated to cause the coin apparatus to dispense the coins from the coin apparatus into a collection receptacle after the machine has been operated, thus, setting up the coin apparatus for the receipt of more coins. The coin apparatus in electrically operated machines is operated in generally the same manner. Two examples of mechanical vending machines using coin operated apparatus are disclosed in U.S. Pat. Nos. 2,952,384 and 3,128,908. Each of the vending machines disclosed in the above-mentioned patents has an upper and lower vending tier for vending articles. However, as noted, the invention is also applicable to one-tier machines which operate in essentially the same manner.

The satellite machine may also be used in conjunction with an electrically operated vending machine, for example, the machine of U.S. Pat. No. 3,000,539 as more fully hereinafter disclosed.

While the following disclosure will entail vending machines which dispense packages of cigarettes, it will be obvious that the principles of this invention apply to other articles. Thus, while the satellite unit has particular advantage in vending 120 mm cigarettes, it could also be used to dispense other packaged products.

BRIEF DESCRIPTION OF THE DRAWINGS

Objects, features and advantages of the invention will be apparent to those skilled in the art from the following detailed description of preferred embodiments taken in conjunction with the accompanying drawings, in which.

DESCRIPTION OF THE INVENTION

Although as noted above, the satellite unit may dispense diverse articles, for purpose and ease of disclosure, the satellite unit will be disclosed as dispensing packages of cigarettes advantageously of 120 mm size.

Figure 1:
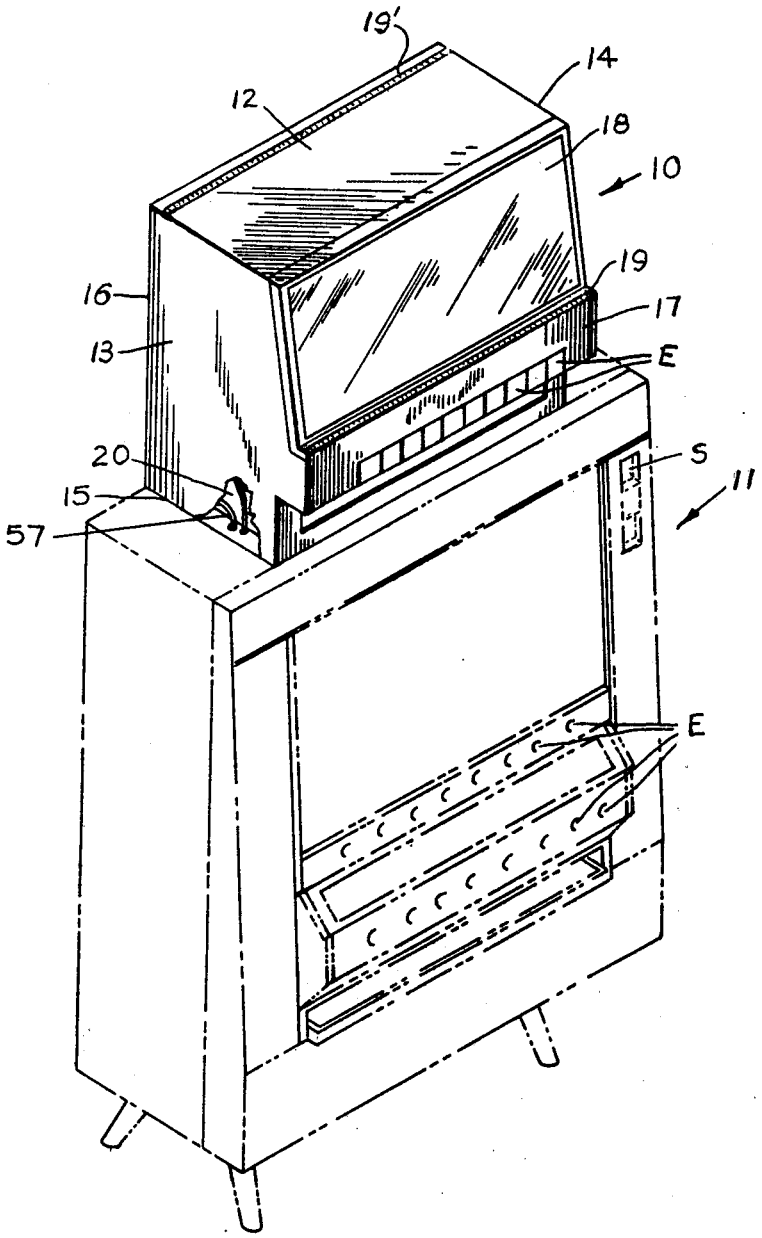
FIG. 1 is a perspective view of a satellite vending machine according to the present invention attached to a basic existing vending machine.

Referring to the drawings, the numeral 10 in FIG. 1 indicates a satellite vending unit that has no coin mechanism. The satellite unit is preferably mounted on and secured to the top of an existing vending unit 11 and is operatively connected thereto for operation under control of the coin mechanism in the existing or basic unit for locking out ejectors of that unit on operation of an ejector in the satellite unit and conversely for locking out the satellite unit on operation of an ejector in the existing unit, as more fully hereinafter described.

The satellite unit has a cabinet having an openable top lid 12, left and right side walls 13 and 14 (left and right being viewed from the front of the cabinet) and a bottom wall 15 which sits and is supported on the top wall of the existing unit 11 as shown in FIG. 1. The cabinet also includes a rear wall 16 and a front wall 17 with a viewing window 18 to enable viewing of the items within the cabinet of the satellite unit. The front wall of the cabinet is advantageously hinged at 19 just below the viewing window (see also FIG. 2) and the top lid at 19' to provide access to the interior of the cabinet.

Figure 2:
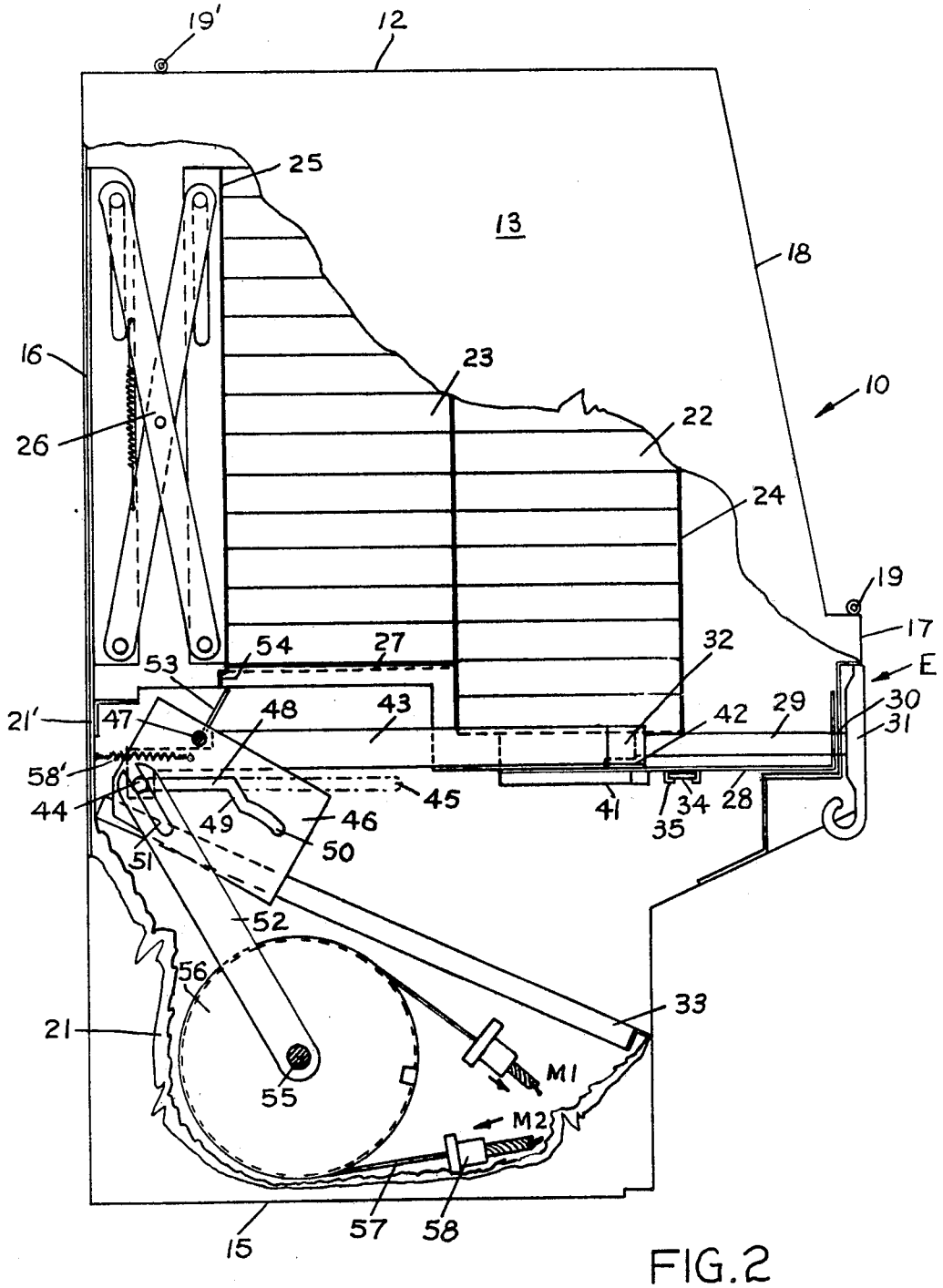
FIG. 2 is a left side elevation view of the satellite vending machine according to the invention.

Inside the cabinet is mounted a dispensing apparatus comprising a frame 20 (see FIG. 1) having side walls the left side wall of which is shown at 21 in FIG. 2 and between which is located an article; i.e. a cigarette pack containing assembly, releasably connected to the rear frame wall 21', comprising a plurality of side-by-side related magazines, each magazine delineating a front and a rear compartment for respectively accommodating a front and a rear column 22, 23 of packs of cigarettes.

More specifically, each magazine has a front wall, side walls and a movable back wall only the front wall 24 and the movable back wall 25 being shown in FIG. 2. The movable back wall has a biased scissor linkage 26 which, as known in the art, moves the rear column of packs of cigarettes in the rear compartment of each magazine forward into the front magazine compartment when all but a predetermined number of packs of cigarettes have been dispensed from the front compartment. In the illustrated embodiment, this occurs when all but two packs of cigarettes have been dispensed from the front compartment. The rear compartment of each magazine is terminated at its bottom by flanges 27, one of which is shown in FIG. 2, extending inwardly from each magazine side wall to form a support for the rear column of packs of cigarettes. The upper ends of the front and rear compartments in each magazine are open to permit stacking of packs of cigarettes therein. The front compartment of each magazine, contrary to its rear compartment, is also open at its bottom end to permit dispensing of packs of cigarettes from the satellite vending unit as more fully hereinafter described.

The satellite unit 10 in FIG. 1 illustratively has ten ejectors E, one for each magazine in the cigarette containing assembly which therefore, in the disclosed embodiment, has ten magazines. Ejectors E are arranged in a horizontal row and when operated eject the bottom pack of cigarettes in the front magazine compartment onto a horizontal shelf 28 (see FIG. 2) extending between the frame side walls of the satellite unit toward the front end thereof. Since ejectors E are of like construction, only one ejector mechanism will be described with reference to FIG. 2, it being understood that the ejector mechanisms of other ejectors are of like construction.

Figure 3:
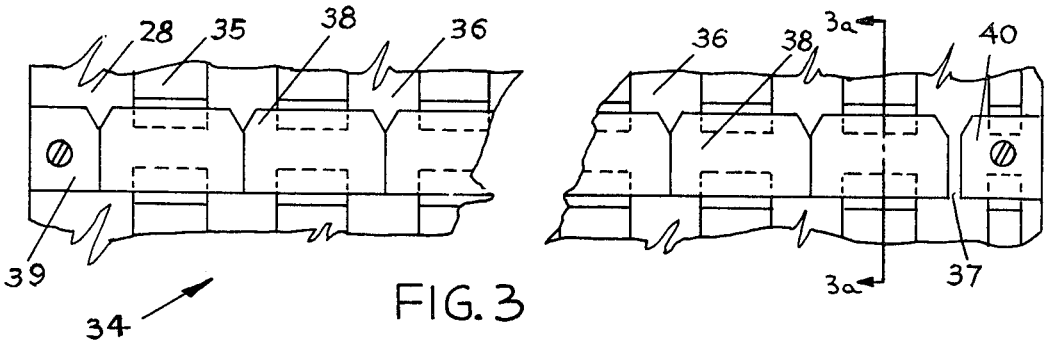
FIG. 3 is a partial plan view of a selector bar used in the satellite vending unit.
Figure 3A:
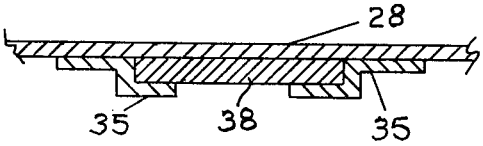
FIG. 3A is a cross-section view taken along Line 3A—3A of FIG. 3.

Each ejector mechanism comprises an operating rod 29 slidably extending through an opening 30 in the front wall of the cabinet. The rod 29 is provided with a knob 31 at its front end and with an ejector head 32 at its rear end. Each ejector head 32 in its normal retracted (rearward) position shown in FIG. 2, underlies a front column 22 of cigarette packs so that the bottom pack in that column bears on ejector head 32. When the operating rod 29 is pulled forward by pulling knob 31, the ejector head 32 moves forward from under its respective stack and the latter drops onto shelf 28. Upon rearward movement of rod 29 to its normal retracted position, the ejector head 32 engages the bottom cigarette pack on shelf 28 and pushes it therefrom into a chute 33 for dispensing from the satellite unit. To lock out all but the one operated ejector mechanism we provide a selector bar and lock-out tumbler arrangement of the type disclosed in U.S. Pat. No. 2,377,413, the disclosure of which is incorporated herein by reference. Thus, we provide a selector element 34 (see FIGS. 2, 3 and 3A) having a plurality of lock-out members, the element being carried below shelf 28 by a plurality of in-turned ears 35 suitably secured to the bottom surface of the shelf. As will be seen in FIG. 3, the shelf has slots 36 in alignment with gaps 37 adapted to be formed between adjacent tumblers 38 on operating an ejector. The two end tumblers 39 and 40 are affixed to the side walls of the frame of the satellite unit. The selector element functions in the following manner to permit only one ejector E to be operated in the satellite unit. When an operating rod is pulled out, it causes the ejector head 32 to move forward so that a web 41, depending from the ejector head through the shelf slot 36 is forced between adjacent tumblers into the gap thus formed, simultaneously forcing the remaining tumblers laterally outward against the fixed end tumblers 39, 40 to prevent further gap formation thereby preventing operation of other ejectors.

As previously described, the back movable wall 25, under action of spring 26, bears on the rear column of cigarette packs 23 which in turn bears on the front column of cigarette packs 22. To permit dispensing of a pack of cigarettes from the front column, it is necessary to retract the back wall 25, against the pressure of spring 26, from engagement with the rear column so as to free the front column for downward movement in its compartment upon operation of an ejector. Also, to prevent simultaneous operation of an ejector in the existing or main vending unit, it is necessary to lock-out all ejector mechanisms in the existing unit to prevent their operation once an ejector in the satellite unit is operated. Structure for accomplishing this two fold purpose and for operating the satellite unit under control of the coin apparatus of the existing vending unit will now be described.

As to operating the satellite unit under control of coins dropped within slot S (see FIG. 1) in the existing unit, suffice it to say that the existing unit includes a rocker shaft which must be rotated to collect the deposited coins in a collection receptacle as well as selector bars to lock-out non-operated ejectors in a given tier. If the existing unit is a two-tier unit, a lock-out mechanism is also provided for locking out all the ejectors of the non-operated tier. Two tier vending machines having suitable selector bars, lock-out mechanisms and rocker shafts are described in U.S. Pat. Nos. 2,952,384 and 3,128,908, the disclosures of which are incorporated herein by this reference thereto.

Suitable means are provided for retracting the movable back wall 25 of each magazine and for locking out all ejectors in the existing unit upon operating any one of the ejectors E in the satellite unit. Such means include a transverse bar 42, just forward of and in the path of the ejector heads 32, connected at its opposite ends to a rearwardly extending draw bar side arm 43 disposed adjacent to and on the inner side of each frame side, only the left side arm 43 being visible in FIG. 2. Accordingly, when any rod 29 is moved forward with its ejector head 32, the latter engages the transverse bar 42, thereby moving the side arms 43, attached thereto, forward along a substantially horizontal path dictated by movement of a pin 44 at the rear end of each side arm 43 in a horizontal slot 45 formed in the frame side walls. Pin 44, as seen in FIG. 2, also moves in a slot formed in a plate 46 fixed to a shaft 47 journaled in the side walls of the frame. The slot in plate 46 has a straight portion 48 and two stage inclined portions 49, 50. The pin 44 furthermore moves in an open ended slot 51 in a lever 52. As the side arm 43 moves forward, pin 44 thereon first moves forward in horizontal slots 45 and 48 and upon reaching the first stage 49 of the inclined slot, effectively rotates the right hand end of plate 46 upwardly (counterclockwise as viewed in FIG. 2) thereby rotating shaft 47 and levers 53, fixedly connected to shaft 47, counterclockwise. Levers 53 are fixed to shaft 47 in alignment and for engagement with tabs 54 on the movable back walls 25 when the shaft 47 is rotated, as described, in counterclockwise direction. It will be understood that the tabs 54 will thus be engaged by levers 53 only when the magazines have within them a front and a rear column of packs of cigarettes, it being apparent from FIG. 2 such engagement will not occur when there is only a front column of packs of cigarettes since back wall 25 and its tab 54 in such event will be forward of the levers 53 and thus out of reach thereof. Levers 53 when engaging the tabs 54 as described, engage them with sufficient force to urge the movable back walls 25 out of contact with the rear column of cigarette packs, thus enabling the front column to drop onto the shelf 28 after the associated ejector head 32 is pulled forward on pulling knob 31. It should be noted that movement of the pin 44 in the second stage slot 50 ensures sufficient out of contact time of the movable back wall 25 with the rear column of cigarettes to permit the packs of cigarettes in the front column to orient themselves for downward movement in the front compartment without jamming therein which might occur if back wall pressure were applied to the rear cigarette column before completion of downward movement of the cigarette packs in the front column.

As above described, the pin 44 also moves in the open slot 51 formed at one end of lever 52. The other end of lever 52 is fixedly secured to a pin 55 which is journaled in the frame side wall. Also carried on pin 55 is a rotatable wheel 56 about which a cable 57 is mounted for movement in the direction of the arrows. The lever 52 and rotary wheel 56 change the reciprocating motion of the ejector rod 29 into rotary motion. The cable 57 extends through the satellite cabinet bottom and through suitable slots cut through the top of the existing vending unit (see FIG. 1). The cable has adjustment means 58 which permit cable slack to be taken up. The cable 57 is used to convert rotary motion of the lever and wheel back to a reciprocating motion.

To summarize, when dispensing from the satellite unit 10, the rod 29 is moved forward (to the right as viewed in FIG. 2) so that the ejector head 32 is moved forward causing side arm 43 to also move forward. Pin 44 on side arm 43 therefore also moves forward, first in the horizontal frame and plate slots 45, 48 and then, while still moving in the horizontal frame slot 45, in the two-stage inclined slots 49, 50 to rotate plate 46 counterclockwise, as previously described. When plate 46 rotates counterclockwise, levers 53 fixed to shaft 47 engage tabs 54 on the lower ends of the movable back walls 25, thus relieving the pressure on the front column of cigarettes to permit packages of cigarettes in the front column to drop onto shelf 28. As previously noted, when the scissor linkage 26 is operated to move the rear column of packages forward into dispensing position in the front compartment, the tab 54 is forward of the lever 53 and, thus, is not engaged thereby.

Simultaneously, when the lever actuating rod 29 and ejector head are moved forward, pin 44 in slot 51 of lever 52 causes lever 52 to be rotated clockwise, thus, rotating wheel 56 in the same direction. The cable 57 is also moved in a clockwise direction as viewed in FIG. 2. The cables at M1 and M2 converge and are crossed on entering the existing vending unit and for this reason move in the lower unit, shown in FIGS. 4 and 5, in the direction of the arrows.

The operating rod 29, after operation as by manually pulling on knob 31, is automatically returned to its normal retracted position by a biasing spring 58' fixedly connected at one end to the frame rear wall and at its opposite end to the side arm 43.

Figure 4A:
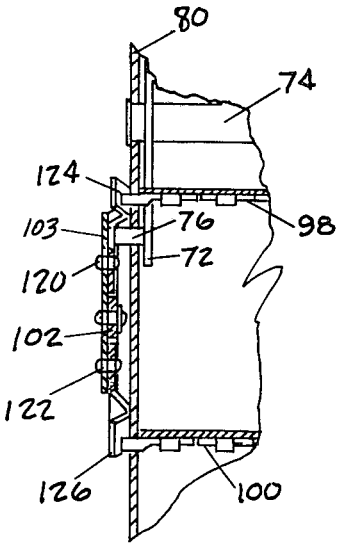
FIG. 4A is a front view of the existing vending unit and the interconnecting linkage of the present invention as shown in FIG. 4.
Figure 4:
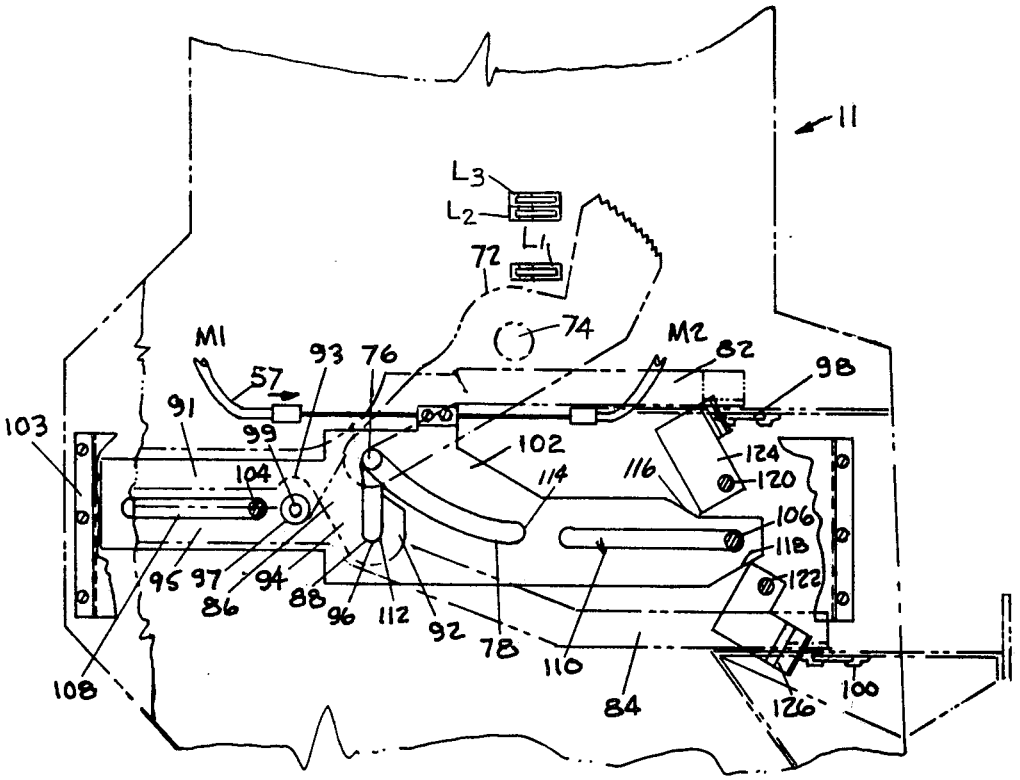
FIG. 4 is a partial side elevation view of one embodiment of a basic existing mechanically operated vending unit showing its operating mechanism and one interconnecting linkage and lock-out mechanism of the present invention.

FIG. 4 is a partial side elevation view of a modified two-tier vending unit, the basic structure of which is more specifically described in the aforementioned U.S. Pat. Nos. 3,128,908. The structure of this patent is modified to include the structure shown in FIG. 4B to enable (*a*) operation of the satellite unit under control of the coin apparatus of the lower unit, (*b*) to lock-out ejectors in both tiers of the lower unit on operating an ejector in the satellite unit and (*c*) to lock-out the ejectors in the satellite unit on operating an ejector in either tier of the lower unit. These objective are realized by providing in the basic unit a slide arrangement and by modifying the lock-out structure for the two tiers of the basic unit without otherwise affecting its operation.

The elements or the lower of existing unit of U.S. Pat. No. 3,128,908 which are not required for an understanding of the present invention are not included in the drawings. Suffice it to say that the unit has a lever 72 at each side of the unit (one of which is seen in FIG. 4A). The lever 72 is fixedly secured to a horizontal shaft 74 extending across the lower existing unit and suitably journaled therein. The horizontal shaft 74 is associated with the coin apparatus for the unit and is permitted to rotate when the correct coins are inserted in the coin apparatus as more particularly described in U.S. Pat. Nos. 3,128,908 and 2,991,867. Thus, as described in these patents, the lever 72 at the right side wall acts as a control lever in conjunction with latches L1, L2 and L3 in a manner more specifically described in U.S. Pat. No. 2,991,867. The shaft 74 acts as a control shaft for the coin apparatus in the same manner as the shaft 27 shown in U.S. Pat. No. 2,991,867 the subject of which is herein incorporated by reference. When the shaft 74 is released for rotation (which occurs when lever 72 is freed by latches L1, L2 and L3 to rotate upon operating an ejector in the lower basic unit after depositing the correct amount of coins) the coins are removed from the coin apparatus to allow the machine to receive new coin deposits. This operation is called clearing or cancelling; therefore, the shaft may also be referred to herein as a cancellation shaft. Each lever 72 has a pin 76 secured to its lower end. The pin 76 on lever 72, as seen in FIG. 4 is adapted to move in a slot 78 of a gusset plate 80 (see FIG. 4A) that is fixedly secured to the frame of the existing unit. Drawbar side arms 82 and 84 for the upper and lower tiers of ejectors are located at each side of the machine and are operated by ejectors in the respective tiers. As disclosed in the abovementioned U.S. Pat. No. 3,128,908, a transverse bar (not shown but which is similar to bar 42 in FIG. 2) extends between the drawbar side arms 82, 84 on opposite sides of the machine and, when one ejector in a tier is pulled, it pulls the transverse bar forward or to the right as viewed in FIG. 4, in a manner similar to that above described with respect to FIG. 2.

The upper drawbar side arm 82 seen in FIG. 4 has a depending hook portion 86 formed with a vertical slot 88 which is adapted to receive the hook engaging pin 76 when an ejector in the upper tier is operated. Extending rearwardly from the hook portion and integrally formed therewith is a horizontal portion 91 formed with a downwardly opening notch 93. The lower drawbar side arm 84 on the other hand has a pair of upwardly extending fingers 92 and 94 which have a configuration similar to the hook portion 86 of the upper side arm 82, and a slot 96, similar to the slot 88 in the hook portion 86, is formed between the fingers. The pin 76 is adapted to be received in slot 96 when an ejector in the lower tier is operated. Also, extending rearwardly from the fingers 92, 94 is a horizontal portion 95 formed with an upwardly opening notch 97. Located in the space between the rearwardly extending portion of the drawbar side arms 82, 84 is a stud 99 provided on a pivotal arm (not shown) which is gravity biased so that the stud normally rests in notch 97. This pivotal arm and stud mechanism is used to lock-out the upper tier if one ejector in the lower tier is pulled and vice versa. Each tier in the existing unit has a selector bar 98 and 100 associated therewith (similar to selector bar 34 in FIG. 2) to lock-out all but one ejector in the tier as has been explained above.

As can be seen from the drawings, if an ejector is pulled in the top tier causing drawbar side arm 82 to move forward, pin 76 will be forced down slot 88 in the hook portion of the side arm so that lever 72 and control or cancellation shaft 74 will be rotated counterclockwise. Also upon moving side arm 82 forward, the lower edge of the rearwardly extending horizontal portion 91 thereof engages the stud 99 and holds it in notch 97 of horizontal portion 95 of the lower drawbar side arm 84, thus, locking out or preventing the ejectors in the lower tier, which are operatively connected to the lower drawbar, from operating.

In like manner, when an ejector in the lower tier is pulled and lower drawbar side arm 84 is moved forward, the pin 76 on lever 72 will now engage slot 96 in the lower drawbar side arm so that lever 72 and control or cancellation shaft 74 will again be rotated counterclockwise. The stud 99 by virtue of forward movement of side arm 84 is pushed out of notch 97 and is moved upwardly into notch 93 and held therein by the upper edge of the rearwardly extending horizontal portion 95, thereby locking out the upper tier ejectors.

When an ejector in either tier is released after its operation to dispense a pack of cigarettes, it is automatically moved rearward by a biasing spring (not shown)

as described in U.S. Pat. No. 3,128,908, causing the relevant drawbar side arm also to move rearward and thus the hook portion of the drawbar which causes the pin 76 on the lever 72 to move in slot 88 or 96 to it original position and thereby rotating shaft 74 clockwise to clear the coin mechanism for further coin deposits.

The above description of the operation of the lower unit 11 is not considered a part of this invention but has been included for a better appreciation of how the satellite unit operates in conjunction with the lower unit.

Suitable interconnecting means are provided for operatively interconnecting the satellite unit with the lower unit to permit operation of the ejectors in the satellite unit under control of the coin apparatus in the lower unit, to lock-out all the ejectors of the lower unit on operating an ejector in the satellite unit and to lock-out all the ejectors in the satellite unit on operating an ejector in the lower unit.

In one embodiment of the invention, the interconnecting means comprises lever 52, wheel 56 and cable 57 in the satellite unit and a reciprocable slide 102 (to which cable 57 is connected as shown in FIG. 4) and blocking members which cooperate with the slide, in the basic existing unit. The blocking members and slide, added to the basic unit for achieving the objectives of the invention are shown in FIG. 4B.

Figure 4B:
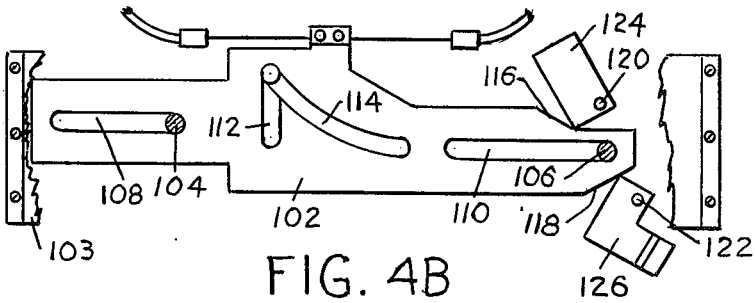
FIG. 4B shows an exploded view the interconnecting link and lock-out mechanism shown in FIG. 4.

Cable 57 after passing through the slot in the upper wall of the lower unit, extends along the side of the lower unit and is attached to the reciprocating slide as shown in FIGS. 4 and 4B. The slide is carried on pins 104 and 106 secured to a plate 103 attached to the existing unit. The pins are received in horizontal slots 108 and 110, respectively, in slide 102 which permits the slide to move only horizontally. The slide 102 has a vertical slot cut-out 112 and an arc slot cut-out 114 which respectively corresponds to the position of the vertical slots 88 and 96 on the side arm drawbars 82 and 84 on the one hand and on the other hand to arc slot 78 in the gusset 80. The slide 102 has an upper forward shoulder 116 and a lower forward shoulder 118. Secured to plate 103 are pins 120 and 122 which carry rotatable blocking members 124 and 126, respectively, the bottom edge of the upper blocking member 124 being positioned so that it will engage the upper shoulder 116 on slide 102 while the upper corner of lower blocking member 126 will engage the lower shoulder 118 on slide 102. These blocking members 124, 126 are utilized to lock-out the upper and lower tier of the lower unit 11 when the satellite unit 10 is operated. The selector bars 98 and 100 of the unit 11 have been modified so that the end tumblers are allowed to float or move laterally as opposed to being fixed, as is the normal construction. The end tumblers extend through an aperture in the slide plate of the unit 11 so that they can be engaged by the blocking members. The end tumblers when engaged by the blocking members, as occurs when the slide moves forward, move a sufficient distance to close all the gaps in the selector bar. This, of course, prevents the ejectors in the upper and lower tiers from being operated.

Having in mind the disclosure thus far prevented with respect to FIGS. 1 to 4B inclusive, to operate the auxiliary unit 10 of FIG. 2, one of the ejectors is pulled whereby the lever 52 and wheel 56 are rotated, which, in turn, moves cable 57 in the direction shown in FIG. 4. Slide 102 is thereupon moved forward (to the right as viewed in FIG. 4) thus causing lever 72 to rotate the control or cancellation shaft 74 counterclockwise since pin 76 moves downwardly into slot 112 of the slide. Rotation of shaft 74 cancels the coin mechanism. The slide 102 also engages the blocking members 124 and 126 which contact the end tumblers in the selector bars 98, 100 and move the selector bars laterally to lock-out the upper and lower tiers of the existing machine 11. It will of course be appreciated that forward movement of the slide will not be possible unless lever 72 and shaft 74 fixed thereto are free to rotate which occurs only when the correct number of coins are inserted in the unit to free lever 72 of latches L1, L2 and L3. If the lever 72 is not free of the locking latches L1, L2 and L3, the lever 72 by means of its pin 76 will restrain the slide 102 against forward movement and thereby forward movement of an ejector in the satellite unit 10.

Should an ejector in either of the upper or lower tier of the basic unit 11 be operated, the tier not operated is locked out by the stud 99 engaging the notch in the rearwardly extending portion of the drawbar side arm as explained hereinabove. The satellite unit 10 in such case will also be prevented from operation because of the following. As an ejector in any one of the upper or lower tiers of the existing machine is operated, its depending web, similar to web 41 described with respect to the satellite unit, is inserted in the gap in the selector bar causing the tumblers to move laterally so that the floating end tumbler moves to a position to engage the relevant blocking member, preventing it from rotating. With the blocking member prevented from rotating, the slide 102 cannot be moved forward because the blocking member will block its movement due to failure of the blocking member to rotate when engaged by the slide. If the slide 102 cannot move, the cable 57 cannot be moved, and, thus, the wheel 56 and lever 52 are prevented from rotating. Therefore, the ejector on the auxiliary unit 10 cannot be operated when either the upper or lower tier of an existing unit is operated.

In the embodiment thus far disclosed, the satellite unit 10 has been described as operatively interconnected with a two tier vending unit of the type disclosed in U.S. Pat. No. 3,128,908. Unit 10 of the invention may however readily be interconnected with other existing one or two tier vending units. For example, the satellite unit shown in FIG. 2 may readily be interconnected with a two tier unit of the type disclosed in U.S. Pat. No. 2,952,384 which for this purpose, is modified to include the structure shown in FIG. 5B to permit operation of the satellite unit under control of the coin mechanism in that existing unit, to lock-out ejectors in both tiers of that existing unit on operating a satellite ejector and to lock-out all satellite ejectors on operating an ejector in either tier of that existing unit. The vending unit of U.S. Pat. No. 2,952,384 thus modified is shown in FIG. 5.

Figure 5A:
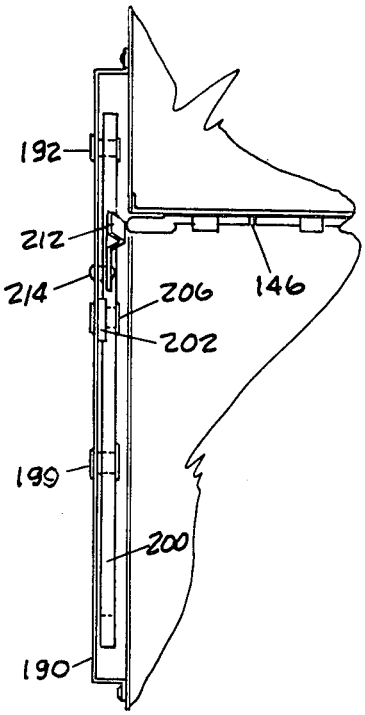
FIG. 5A is a front view of the existing vending unit and interconnecting linkage of the present invention shown in FIG. 5.
Figure 5B:
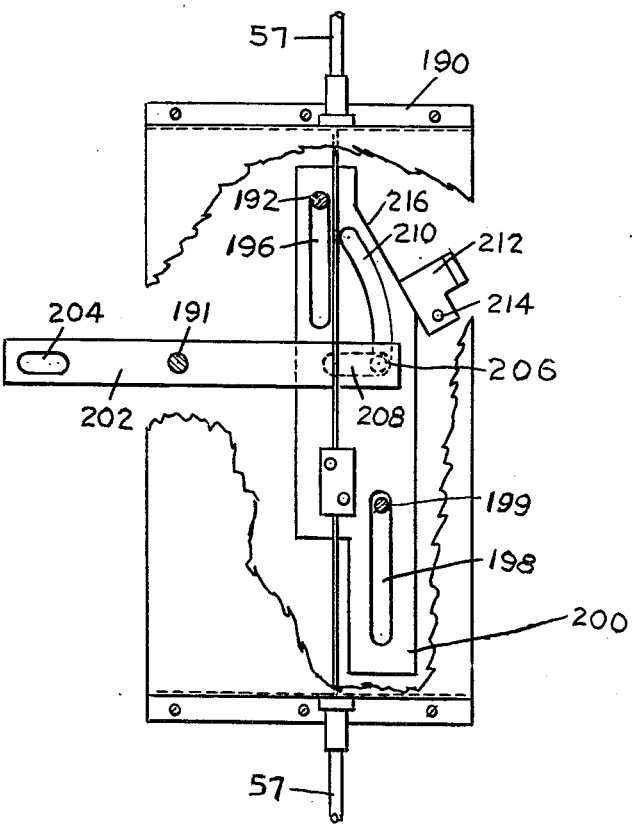
FIG. 5B shows an exploded view the interconnecting linkage and lock-out mechanism shown in FIG. 5.
Figure 5:
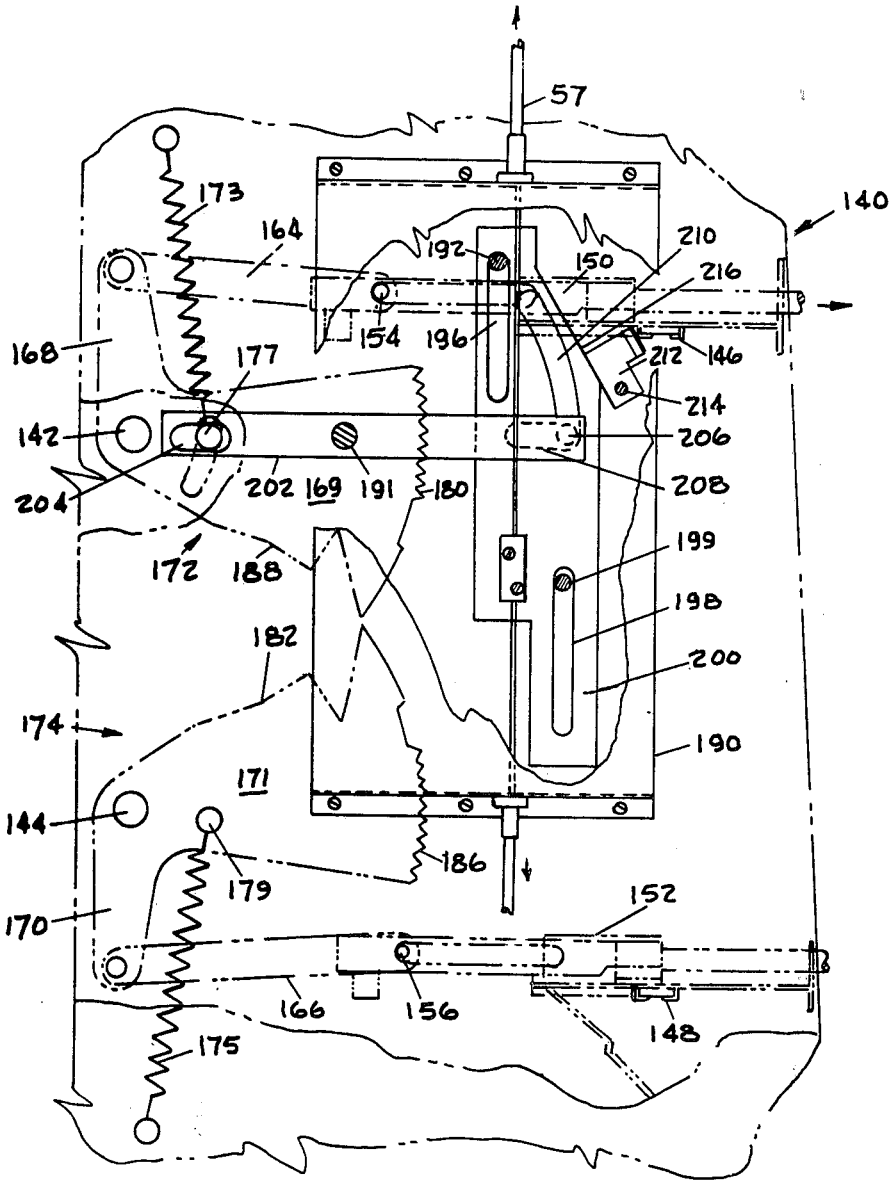
FIG. 5 is a partial side elevation view of another embodiment of an existing mechanically operated vending unit showing its operating mechanism and another interconnecting linkage and lock-out mechanism of the present invention.

In FIG. 5, numeral 140 indicates a two-tier unit having two rockers shafts 142 and 144 associated with an upper and lower tier of the unit. The rocker shafts (as was shaft 74 in the previously described embodiment) are associated with the coin apparatus of the vending unit. As more fully disclosed in U.S. Pat. No. 2,952,384 insertion of coins in the coin apparatus unlocks these shafts and permits them to rotate. Upon rotation of either of the shafts, the coin mechanism is cleared or cancelled and made ready to receive another coin deposit.

The two-tier unit 140 has ejectors and selector bars 146, 148, similar to those of U.S. Pat. No. 3,128,908 above described, to permit only one ejector per tier to operate at any one time. These selector bars operate in a manner similar to selector bars 98 and 100 of the FIG. 4 unit. The upper and lower side arms 150 and 152, respectively, are moved by the ejectors in a manner similar to side arms 82, 84 in FIG. 4, moreover well known in the art, and carry studs 154 and 156. Links 164 and 166 are pivotally secured at one end to the studs 154 and 156, respectively, and at their opposite ends to crank arm portions 168 and 170 which together with the integrally formed large wedge portions 169 and 171 form levers 172 and 174. Levers 172 and 174 are fixedly secured to rocker shafts 142 and 144. Springs 173 and 175 are secured to pins 177 and 179, respectively, on levers 172 and 174 and to the machine frame as shown in FIG. 5 to bias lever 172 counterclockwise and lever 174 clockwise.

The above described mechanism is part of the existing unit 140 and operates in the following manner. When an ejector in the upper tier is pulled, the selector bar 146 locks out other ejectors in that tier and causes side arm 150 to move to the right as viewed in FIG. 5. The movement of the arm 150 causes the link 164 to rotate crank arm 168 in a clockwise direction which, in turn, rotates the wedge portion 169 of lever 172 clockwise. The wedge portion 169 of the lever 172, when rotated clockwise, is positioned so that edge 180 is moved adjacent the upper surface 182 of the wedge portion 171 of the lower lever 174. When the upper lever is thus positioned, it prevents the lower lever from rotating in counterclockwise direction, thereby preventing any ejector in the lower tier from operating. The rotation of the lever 172 which is fixed to the rocker shaft 142, causes the shaft 142 to rotate, thereby clearing the coin apparatus.

The lower tier operates in a similar fashion and, when the outer edge 186 of the lower lever 174 is positioned adjacent to lower surface 188 of the upper lever 172, the upper lever is prevented from rotating in clockwise direction. Similarly, the movement of the lower lever 174 rotates the lower shaft 144 and clears the coin apparatus. The above described elements are existing parts of the unit 140 and do not constitute a part of the present invention. The present invention relates to the interconnecting linkage between the elements of the unit 140 and the satellite unit 10.

To enable interconnection of the unit of U.S. Pat. No. 2,952,384 with the satellite unit of FIG. 2, for purposes hereinbefore disclosed, the unit of this U.S. patent is modified as shown in FIGS. 5, 5A and 5B wherein the numeral 190 indicates an attachment plate secured to the side wall or frame of the existing unit 140. Pins 192 and 199 are secured to the plate 190 and are inserted into vertical slots 196 and 198 of the slide 200. Slide 200 has the cable 57 from the satellite unit of FIG. 2 attached thereto and, thus, will reciprocate vertically, as viewed in FIG. 5, when the cable 57 is moved in the manner previously described. A lever 202 is pivotally supported by pin 191 fixed to the plate 190 and has an opening 204 at its left-hand end (as viewed in FIG. 5) which receives pin 177 on upper lever 172. On the right-hand end of lever 202 is a fixed pin 206 which extends through the slide 200 at the juncture of a horizontal slot 208 and an upwardly extending arc slot 210 as shown in FIG. 5.

Forward of the slide 200 is a blocking member 212 which pivots a pin 214 which is secured to plate 190. The blocking member 212 is positioned so that it will engage the selector bar 146 as the slide 200 is moved upward by cable 57 on operating an ejector in the satellite unit. The sloped edge 216 of the slide engages the blocking member 212 causing it to engage the selector bar 146 as will be explained hereinafter. The selector bar 146 is modified so that the end tumbler adjacent the blocking member floats similar to the selector bars 98 and 100 of unit 11 as above described.

The interdependent operation of the unit 140 and the satellite unit 10 is as follows. Should an ejector in the satellite unit be pulled, the satellite unit will function as above described with respect to FIG. 2. However, the cable 57 in FIG. 5 is connected to the slide 200 to move it vertically rather than horizontally as in FIG. 4. Upward movement of the cable 57 in the direction of arrow B causes slide 200 to move upwardly so that its edge 216 engages blocking member 212 and rotates it into contact with selector bar 146 thereby locking out the upper tier ejector in the same manner as when edge 116 of slide 102 engages upper selector bar 98 in the FIG. 4 embodiment. Pin 206 on lever 202, during upward movement of the slide, moves into slot 208 in slide 200, thus, causing the left-hand end of the lever 202 (as viewed in FIG. 5) to move counterclockwise with respect to its pivot pin 191 which, in turn, causes the wedge portion 169 of lever 172 to move clockwise so that it is positioned above lever 174, thereby also locking out the lower tier. The upper side arm 150 during clockwise movement of lever 172 is allowed to move forward in the usual manner even though no ejector has been pulled.

Should an ejector in the upper tier of machine 140 be pulled instead of the ejector in the satellite unit as just described, the machine's lock-out mechanism operates in the normal manner, previously described, to lock-out the lower tier; i.e. the wedge portion 169 of lever 172 blocks movement of wedge portion 171 of lever 174. The tumblers of selector bar 146 are furthermore moved laterally by a web similar to web 41 shown in FIG. 2 so that the free end tumbler engages blocking member 212 preventing it from rotating which, in turn, prevents slide 200 from moving upwardly, thus, cable 57 cannot be moved. If cable 57 cannot be moved, the ejectors in the satellite unit cannot be pulled and are therefore also locked out. Simultaneously, pin 206 moves upwardly in arc slot 210 upon counterclockwise rotation of the left-hand end of lever 202 about pin 191, which occurs when the wedge shaped portion of lever rotates clockwise, as it does with its pin 177, when an upper tier ejector is operated.

If an ejector in the lower tier is operated, the upper tier is locked out in the normal manner by edge 186 which blocks lever 172 from rotating about its pivot 142 thereby preventing pulling of an ejector in the upper tier. If lever 172 cannot rotate then lever 202 is also prevented by pin 177 on the lever 172 from rotating about pivot 191 so that pin 206 and lever 202 cannot be moved from its position shown in FIG. 5 and thus prevents the slide from moving upwardly. If the slide cannot be moved then cable 57 cannot be moved so that the ejectors in the satellite unit cannot be pulled and are therefore locked out. It will thus be appreciated that in the FIG. 5 embodiment lever 202 acts as the blocking member for blocking movement of the slide for locking out the satellite unit 10 when a lower tier ejector is pulled. This blocking member takes the place of blocking member 126 in the FIG. 4 embodiment and operates independently of selector bar 148 in the FIG. 5 embodiment.

Figure 6:
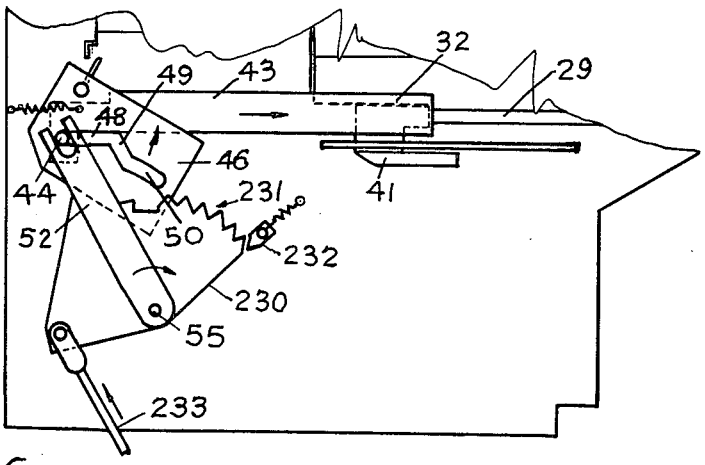
FIGS. 6 and 7 are partial side elevation views of the satellite machine and a basic vending machine respectively showing another form of interconnecting linkage between the satellite and the basic machines according to the invention.

FIG. 6 discloses a modified satellite unit linkage for interconnection with a basic unit beneath it and differs from the FIG. 2 showing in that a wedge-shaped plate member 230 is substituted for the wheel 56 and a rod 233 replaces the cable 57. To avoid repetition, those parts in FIG. 6 which are similar and function the same as the parts described in FIG. 2 have been assigned the same reference characters and will not again be described.

As is apparent in FIG. 6, the plate member 230 has attached thereto one end of lever 52 by means of pin 55 which, as in the FIG. 2 embodiment, is journaled in the frame of the satelite vending unit. The upper forward edge of the plate has a toothed surface 231 which engages a dog 232 resiliently mounted on the frame to prevent the ejector from being pushed rearwardly, once it has been moved forward far enough for engagement of the toothed surface with the dog, until the ejector has been pulled completely forward to free the toothed surface from the dog, subsequent to which the ejector may be urged rearwardly to its normal retracted position. Attached to the plate 230 opposite its toothed surface is the rod 233 which extends into the cabinet of the existing vending unit 11. The rod 233 as abovementioned, replaces cable 57 shown in FIG. 2.

Figure 7:
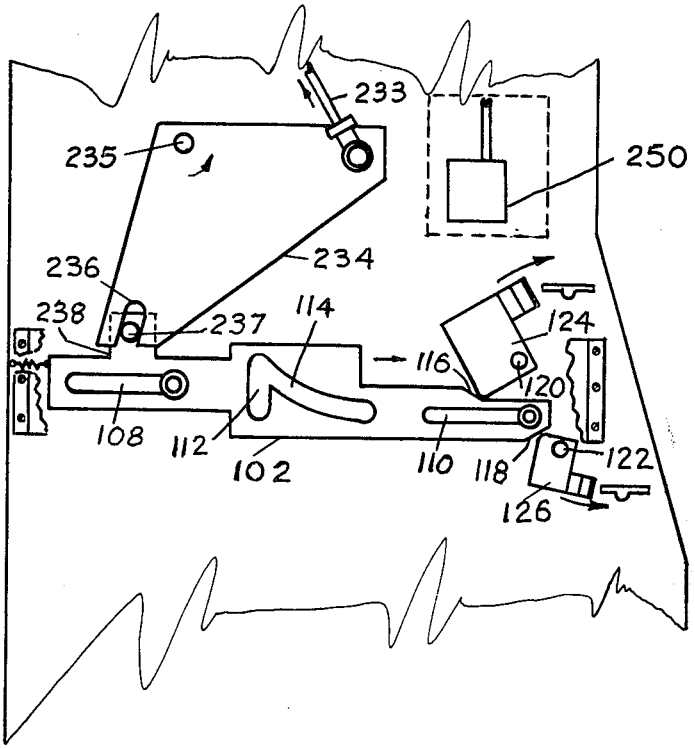

FIG. 7 (except for the components within the dash-line box hereinafter described) shows structure which when substituted in the basic unit of FIG. 4 for that part of the structure therein shown in FIG. 4B, adapts the basic unit for operation by the rod 233 rather than the cable 57. In FIG. 7, those parts which are similar and function the same as the parts described in FIG. 4B have been assigned the same reference characters and will not again be described.

As will be seen in FIG. 7, the opposite end of the rod 233 is attached to one apex of a generally triangular-shaped plate member 234 which is pivotally attached to the existing unit 11 by pin 235 at another apex. The third apex of the triangular-shaped member has a sloped slot 236 into which a pin 237 is inserted. The pin 237 is carried on an upwardly extending tab 238 which is formed integrally with slide 102. It should be understood that the wedge-shaped plate member 230, rod 233 and triangular-shaped member 234 perform the same function of transferring the reciprocating motion of the ejector of the satellite vending unit to the slide member 102 as is done by wheel 56 and cable 57 as above disclosed.

Figure 8:
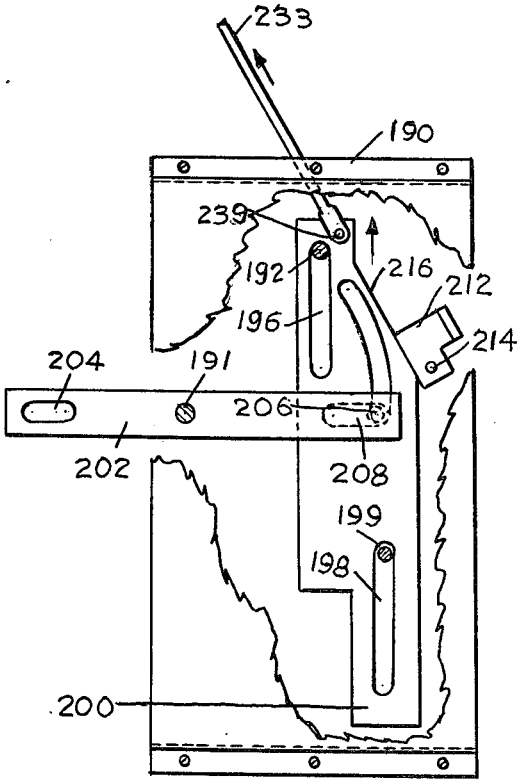
FIG. 8 is a partial elevation side view of another form of interconnecting linkage for use with the satellite machine of FIG. 6.

The interconnecting linkage shown in FIG. 6 can also be used with the unit of FIG. 5 if for that part of the structure therein shown in FIG. 5B, there is substituted the structure shown in FIG. 8. For the sake of brevity, those parts in FIG. 8 which are similar and function as do the parts described in FIG. 5B, have been assigned the same reference characters and will not again be described. Suffice it to say that with FIG. 5 modified to include the structure of FIG. 8 in place of the structure shown in FIG. 5B, the rod 233 from the satellite unit of FIG. 6 need only be attached to the upper end of the slide as at 239. The use of rod 233 in place of cable 57 for vertically moving the slide does not alter the operation of the existing unit which remains the same as that described for the FIG. 5 cable pulling embodiment. The advantage of using the rod 233 in place of the wheel 56 and cable 57 is that the rod assures positive drive of the slide.

Figure 9:
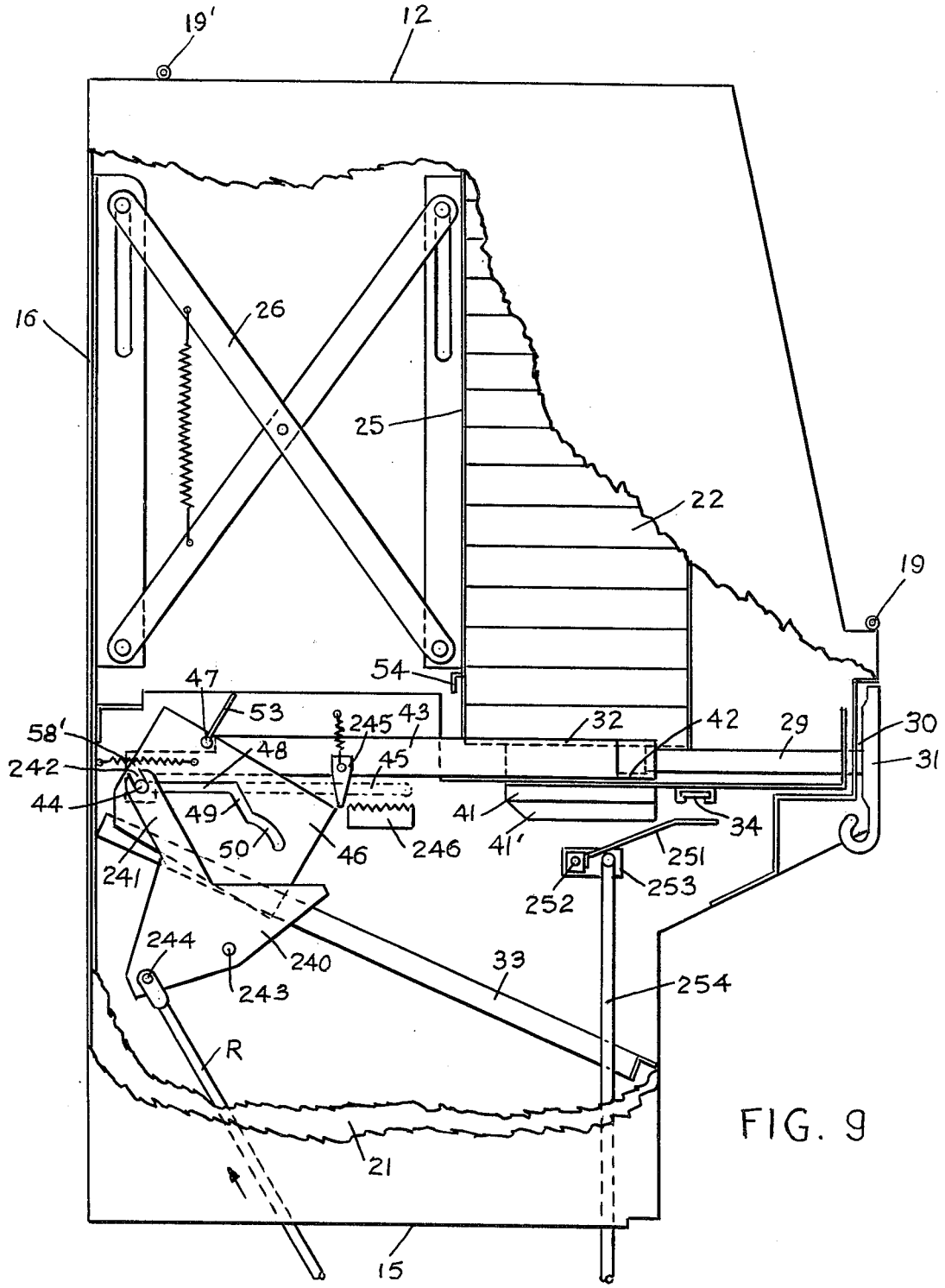
FIG. 9 is a partial elevation side view of yet another embodiment of a satellite machine according to the invention.

FIG. 9 shows a preferred form of the satellite unit which may be used with the basic units of FIGS. 4 and 5 when the latter are modified to include the structures of FIGS. 7 and 8 in place of those shown in FIGS. 4B and 5B respectively so that the slides of the thus modified basic units may be reciprocated by rod R shown in FIG. 9. In FIG. 9, those parts which are similar to and function the same as the parts described with respect to FIG. 2 have been assigned the same reference characters and will only be described to the extend deemed necessary for an understanding of the invention. Suffice it to say that when knob 31 is pulled forward, ejector head 32 also moves forward pulling with it the transverse bar 42 and thus the side arm 43 connected to the ends of bars 42, all as previously described with respect to the FIG. 2 embodiment. As the left side arm 43 moves forward, pin 44 thereon also moves forward to tilt plate 46 and the levers 53 on shaft 47 into engagement with tab 54(when the rear magazine compartment has a stock of cigarette packages). As in the FIG. 2 embodiment, plate 46 is thus tilted when the pin 44 moves through horizontal slots 45 and 48, the former in the side frame and the latter in plate 46, and thereafter into the two stage inclined slots 49, 50. The FIG. 9 embodiment thus far described will be seen to operate in the same manner as the FIG. 2 embodiment. In FIG. 9, the biased scissor linkage has moved back wall 25 forward which will occur, as previously explained, when all but two packs of cigarettes have been dispensed from the front column.

The FIG. 9 embodiment differs from the FIG. 2 embodiment in utilizing in place of lever 52, wheel 56 and cable 57, the wedge-shaped plate 240 having a reduced neck portion 241 provided with an open slot 242 in which pin 44 is disposed. Accordingly, as the pin 44 moves forward through the horizontal slots 45 and 48, (in the same manner as described with respect to FIG. 2) it moves the wedge-shaped plate clockwise about shaft 243 fixed to the frame. The rod R is attached at 244 to plate 240 so that when the plate 240 is rotated clockwise about shaft 243, on forward movement of pin 44 while in slot 242 in the plate neck portion 241, the rod R is moved in the direction of the arrow. The rod R in FIG. 9 may be connected to the slide of FIG. 7 or 8 in the same way that the rod 233 is connected thereto.

In the preferred embodiment of FIG. 9, we provide a dog 245, serving as a stop, resiliently mounted on the side arm 43 for movement therewith. Fixed to the frame side wall is a ratchet 246 the teeth of which are positioned in the path of movement of the dog. The dog, once engaging the ratchet teeth, on initial forward movement of an ejector, prevents reverse movement of the ejector until the dog clears the ratchet teeth which occurs only on completing full forward movement of the ejector whereafter the ejector may be returned to its normal rearward retracted position. It will be appreciated that conversely, on initial rearward movement of the ejector after fully pulling the ejector forward, once the dog engages the ratchet teeth, it will not be possible to reverse ejector movement; i.e. forward movement until the dog again clears the ratchet teeth which occurs in the fully retracted position of the ejector. The dog and ratchet prevent undue loading of and possible damage to the rod R which could occur if the direction of ejector movement were reversed before completion of a full stroke.

If the basic unit includes a price differential linkage, as for example schematically shown in the dash line box enclosure in FIG. 7 at 250 the satelite unit of FIG. 2, 6 or 9 will then include a mechanism which will operate such linkage. For purpose of illustration such mechanism it is shown in FIG. 9, it being readily apparent that the satelite units of FIGS. 2 and 6 could similarly be adapted.

In FIG. 9 a resilient blade 251 is fixedly attached to a shaft 252 which is suitably journaled in the unit's frame. The shaft also carries a rectangular-shaped member 253 which has a pusher rod 254 connected to its forward end. The pusher rod is connected to the price differential linkage 250 in the basic unit 11 (see FIG. 7) and will manipulate this price differential linkage so that the movement will be translated from the linkage to the coin mechanism of the existing unit. When an ejector of the auxiliary vending machine is operated, it engages through the intermediary of web 41, and extension 41' thereon, the blade 251, and pushes it downwardly, thus, causing the pusher rod 254 to move downwardly which, in turn, operates the price differential linkage. It will be understood that the blade 251 will be fixed to shaft 252 in the path of those webs 41 and their extensions 41' which are associated with ejectors which dispense higher price cigarette brands.

Figure 10:
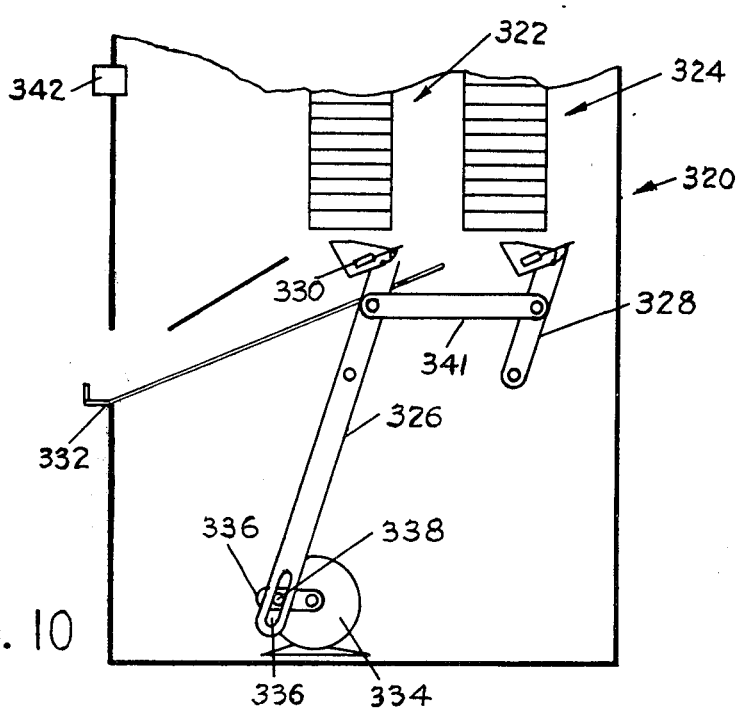
FIG. 10 is a partial side elevation view of one embodiment of a basic existing electrically operated vending machine showing its operating mechanism.

In the disclosure thus far made, the satellite unit has been described as interconnected with a basic, mechanically operated, vending unit. The satellite unit can also be interconnected with an electrically operated vending unit, for example, the vending unit of U.S. Pat. No. 3,000,539, the disclosure of which is incorporated herein by this reference thereto. Only those parts of the vending unit of this patent which are necessary for an understanding of the invention are shown in FIG. 10. It should be understood, however, that the satellite unit of the invention may be interconnected with other electrically operated basic units by following the principles of the invention as hereinafter described.

Referring to FIG. 10, vending unit 320 has a front and back bank 322 and 324, each containing a plurality of magazines or columns. Each magazine in the front and back bank is associated with an ejector swing arm 326 and 328. The ejector swing arms carry cradles 330 which in turn carry a solenoid ejector unit which removes the lower pack from the magazine selected and drops it into chute 332. The forward swing arm 326 is connected to a motor 334 by lever 336 and shaft 338 which extends through a slot 340 in the lower end of the swing arm 326. The rear swing arm 328 is pinned to the frame and to the front swing arm by linkage 341. Each time coins are deposited in the coin mechanism, the electrical circuitry of the machine is set up so that when the correct number of coins are deposited and a product is selected by depressing a push-button switch 342, accessible at the front end of the unit, the solenoid in the cradles 230 corresponding to the brand selected, is energized. As known to those skilled in the art, and moreover disclosed in U.S. Pat. No. 3,000,539, the remaining solenoids are locked out on operating one of the push-button switches on the unit front panel and the motor 343 is started to cause the swing arms to move forward. Since only the solenoid in the cradle of the selected product is energized, only the lowermost package in its associated column is removed and ejected from the machine. Upon operation and ejection of the package, the coin mechanism is cleared as more fully disclosed in U.S. Pat. No. 3,000,539 to receive new coin deposits.

Figure 11:
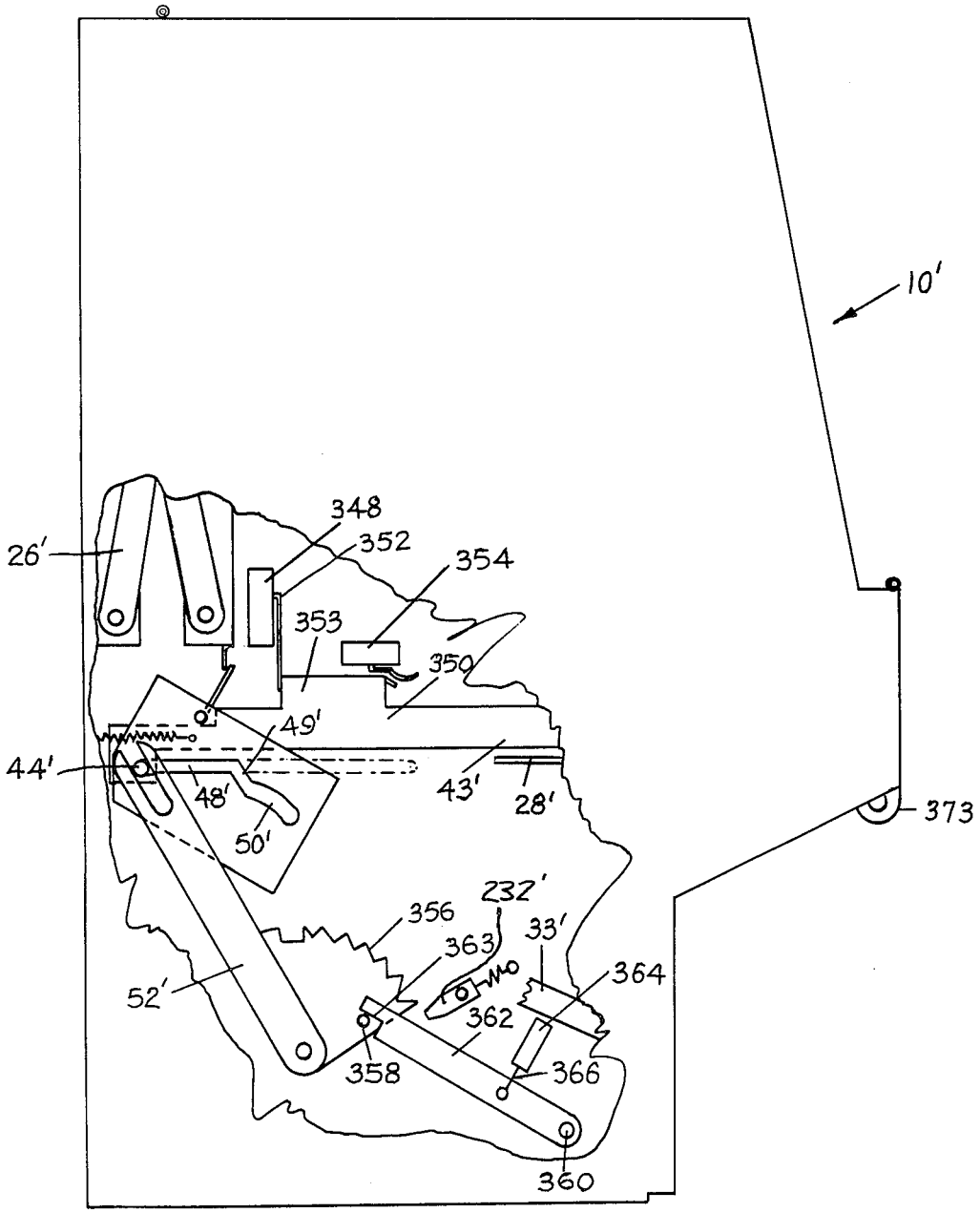
FIG. 11 is a partial elevation side view of the electrical embodiment of a satellite vending machine according to the present invention.

FIG. 11 illustrates a satellite unit 10' modified for use with a basic electrical vending machine, for example, the basic machine described above. The satellite unit is similar to those previously described except for the following. A pressure actuated switch 348 is secured to the frame of the unit so that when the side arm 350, having an upwardly extending projection 352, is moved forward, the pressure on the switch is relieved and its state is changed, i.e. it is closed. Another, normally open, switch 354 is positioned on the frame just in front of a stepped portion 353 on the side arm so that, as the side arm moves forward, switch 354 is also engaged to close the contacts thereof. Switches 348 and 354 are interconnected with the electrical circuits in the electrical vending unit 320 of FIG. 10 in a manner and for a purpose hereinafter described. The satellite unit in FIG. 11 (like parts to those previously described being identified by the same reference character primed) also embodies a lever 52' similar to lever 52 in FIGS. 2 and 6 and is rotated in like manner when pin 44' is moved forwardly in the straight 48' and inclined slots 49' 50' in plate 46'. As in the case of FIG. 6, in place of the wheel 56 in FIG. 2, we provide a ratchet 356 which in this embodiment, however, carries a pin 358 near its forward end. The ratchet 356 is adapted to engage resiliently mounted dog 232' for the same purpose described with respect to plate member 230 and dog 232 in the FIG. 6 embodiment. It will also be observed that contrary to the satellite units of FIGS. 2, 6 and 9, a mechanical linkage, such as cable 57 in FIG. 2, rod 233 in FIG. 6 or rod R in FIG. 9, is not provided since it is not needed inasmuch as the interconnection of the satellite unit with the basic unit is electrically not mechanically effected.

To lock out the satellite unit 10' on operating a push-button switch 342 in FIG. 10, there is secured to the frame of the satellite vending unit, forward of the ratchet, a pin 360 which carries a pivotal latching lever 362. Intermediate the ends of the latch lever 362 and secured to the frame is a solenoid 364 having its core 366 secured to latching lever 362. The end face of the latching lever has a notch 363 for engaging the pin 358 on ratchet 356. So long as the solenoid 364 is not energized, which is the case when a push-button switch 342 in the existing unit is operated, the lever will remain in the position shown in FIG. 11 so that notch 363 engages pin 358 on ratchet 356 to prevent its rotation by lever 52'. If ratchet cannot be rotated then ejectors in the satellite unit cannot be pulled forward. Conversely, if an ejector in the satellite unit is pulled forward, switch 348 closes to energize a relay (not shown) which is effective through contacts thereof to connect the satellite unit with the electrical circuitry of, for example, the basic machine of FIG. 10 simultaneously rendering push-button switches 342 ineffective to energize the solenoids of the package ejector units. Solenoid 364 in FIG. 11 is energized as hereinafter described, on pulling an ejector in the satellite unit a distance sufficient to operate switch 348. On energization of solenoid 364, lever 362 fixed to the core 366 of the solenoid is pulled by the core in a direction which withdraws the notched face of lever 362 from pin 358, thus enabling complete withdrawal of the ejector in the satellite unit. In the course of full withdrawal of the ejector in the satellite unit, switch 354 is closed for a purpose hereinafter disclosed.

Figure 12:
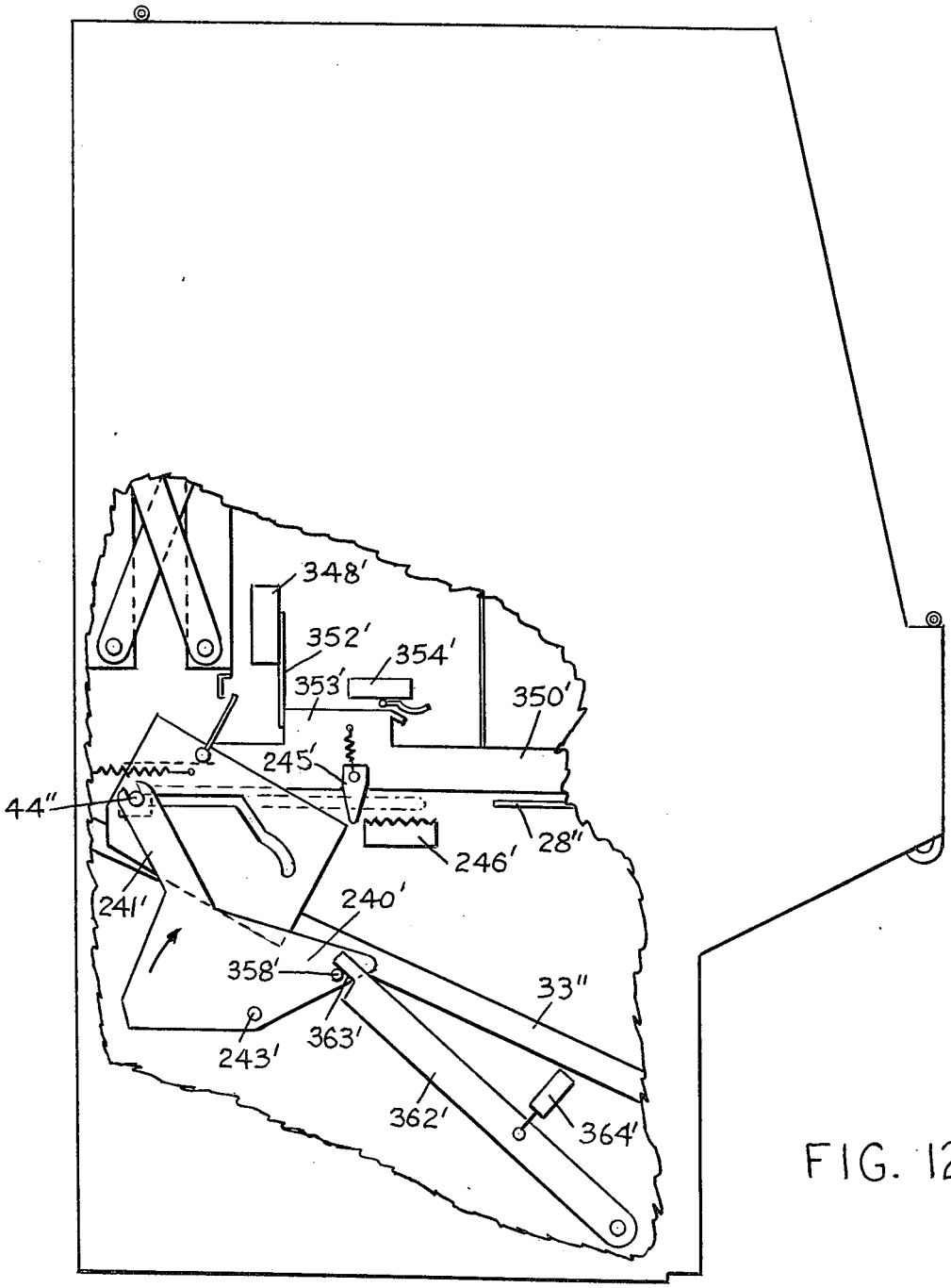
FIG. 12 is a partial elevation side view of a modified form of an electrical embodiment of the satellite machine according to the invention.

FIG. 12 shows a preferred form of a satellite unit for electrical interconnection with the basic unit of FIG. 10. Like parts to those described in FIG. 9 and 11 are identified by the same reference characters primed.

As will be seen by comparing FIG. 12 with FIG. 9, the structure in these Figures are similar, the basic difference being the elimination from FIG. 12 of rod R shown in FIG. 9 and the addition in its place of lever 362' the function of which is similar to that of lever 362 in FIG. 11. Thus, when an ejector is pulled, assuming pin 358' is free of the lever notch 363', side arm 350' will move forward carrying with it pin 44" and thus the neck portion 241' of wedge-shaped plate 240'. As in the FIG. 11 embodiment, the notch is moved free of the pin 358' upon energization of solenoid 364' which occurs after the contacts of switch 348' are closed, as previously described. Suffice it to say that all the mechanically operated parts in FIG. 12 operate in the same manner as the corresponding parts in FIG. 9 (except for the rod R omitted in FIG. 12) and all of the electrical parts e.g. switches 348' and 354' as well as solenoid 364' in FIG. 12 operate in the same manner and have the same function as in the FIG. 11 embodiment. Thus in FIG. 12, as in FIG. 11, the ejector in the satellite unit cannot be pulled forward all the way unless switch 348' is first operated and solenoid 364' is thereafter energized. Switch 354' is closed in the course of full withdrawal of the ejector in the satellite unit for a purpose hereinafter disclosed.

Figure 13:
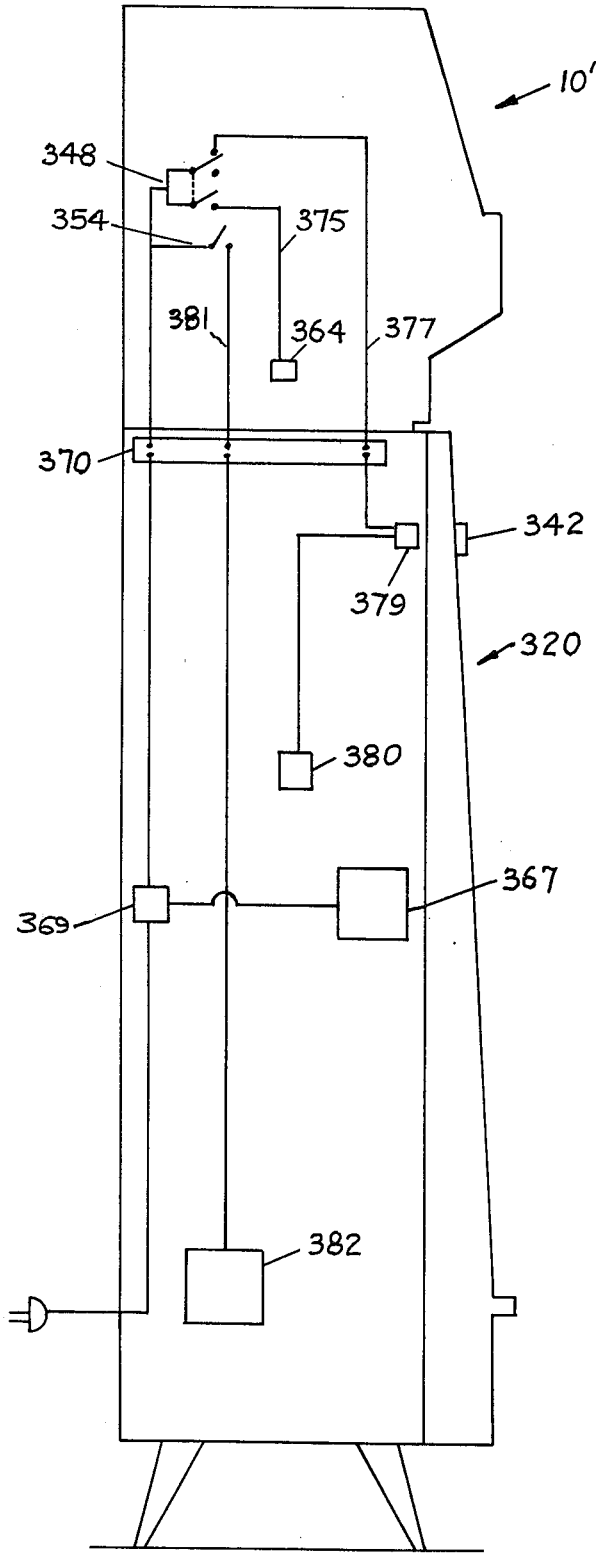
FIG. 13 is a block diagram of the circuit of the satellite vending unit illustrated in FIG. 11 and the hook-up to an existing vending machine circuit.

FIG. 13 is a block diagram for explaining how the satellite and basic unit are electrically interconnected for enabling the satellite unit to be operated from the coin apparatus in the existing unit, for locking out the existing unit on operating an ejector in the satellite unit and for locking out the satellite unit on operating an ejector in the basic unit. It is to be understood that the block diagram of FIG. 13 applies to the FIG. 11 or FIG. 12 satellite unit when electrically interconnected with a basic unit such as shown, for example, in FIG. 10. The block components function as follows.

When coins are inserted into the coin mechanism 367 of the existing electrical unit, a signal is sent to a release mechanism 369 for the ejectors of the basic unit which is, in turn, connected to a terminal board 370 and from the terminal board to switch 348 in the auxiliary unit. If a selector button 342 on the unit 320 is depressed, the unit 320 works normally. If, however, an ejector lever 373 (see FIG. 11) on the auxiliary unit is operated, switch 348 is closed and power passes through wire 375 (see FIG. 13) to energize solenoid 364 in the auxiliary unit so that the latching lever 362 is removed from the ratchet pin 358 to permit the ejector 373 to be reciprocated. Also, a signal is sent by wire 377 through terminal board 370 to the existing machine 320 to deenergize the selector solenoid 379 locking out its ejector units and removing power from the coin return circuit 380. When switch 354 is engaged upon operation of the ejector in the auxiliary unit 10', another signal is sent by wire 381 through the terminal board 370 of the existing unit 320 to energize the existing unit circuitry 382 to collect the coins and cancel the unit accumulator.

Figure 14:
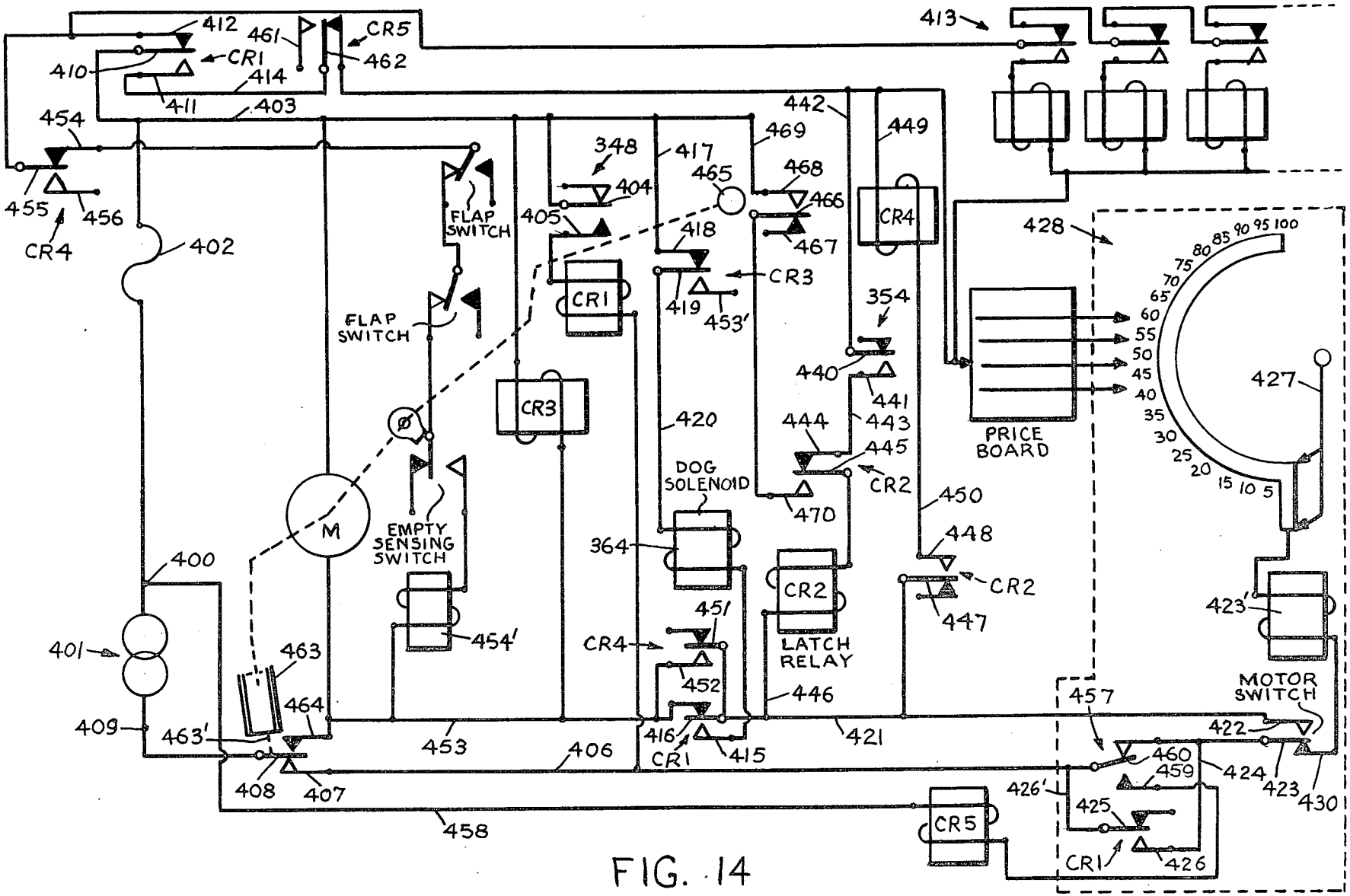
FIG. 14 is a circuit diagram showing how the satellite machine is electrically adapted for electrical interconnection with the basic electrical machine.

FIG. 14 shows more specifically how the first switch 348, solenoid 364 and second switch 354 in the satellite unit are connected into the electrical circuit of the basic unit to (*a*) enable operation of the satellite unit under control of the coin mechanism of the basic unit, (*b*) lock-out the dispensing solenoid circuits in the basic unit on operating a satellite ejector and (*c*) lock-out the satellite ejectors on operating the basic push-button switches. The electrical circuit of the basic unit and its operation are described in Rowe International Inc. SERVICE MANUAL PARTS CATALOGUE 526/428 CIGARETTE VENDOR PART NO. 900-52602D, pages 1-31, published December 1974, the disclosure of which is incorporated herein by reference.

Referring to FIG. 14, switch 348, as previously described, is closed on initially pulling forward an ejector in the satellite unit. Closure of switch 348 completes a circuit from terminal 400 of a power source 401 (i.e. 115 volt 60Hz) through fuse 402, lead 403 to contact 404 of switch 348, mating contact 405 which it engages on pulling forward the ejector, the winding of relay CR1, lead 406, motor contact 407, mating contact 408 and back to the opposite terminal 409 of the power source. The circuit just traced energizes relay CR1 which causes its associated contacts 410 and 411 to engage. Closure of contacts 410 and 411 removes the power source from contact 412 and thereby from the selector switches and solenoids 413 in the basic unit and transfers power from the power source to line 414. The ejectors in the basic circuit are therefore locked out and the solenoids 413 therein cannot be energized on operating an ejector in the satellite unit.

Energization of relay CR1 also closes contacts 415 and 416. With these contacts closed a circuit is completed (assuming completion of a circuit including the coin mechanism in the basic machine when the correct coin amount is deposited as hereinafter described) which includes the winding of dog solenoid 364 which is therefore energized, the circuit comprising terminal 400, fuse 402, lead 403, lead 417, mated contacts 418, 419, lead 420, the winding of dog solenoid 364, contacts 415 and 416 (which engaged on energization of relay CR1) lead 421, contacts 422, 423 which mate on energization of unlatch solenoid 423' when the correct coin amount is deposited, lead 424, contacts 425, 426 which mate on energization of relay CR1, lead 426', lead 406, contacts 407, 408 and terminal 409 of the power source. Contacts 422 and 423 in the circuit just described engage on deposit of the correct coin amount determined by a price board setting for articles to be dispensed. More specifically, and as known in the art, movable switch arm 427 of coin mechanism 428, with each coin deposit, moves clockwise, as viewed in FIG. 14, a circuit being completed when arm 427 is positioned at the price board setting of the selected article; e.g. when the coins deposited add to the price board setting, the circuit comprising terminal 400, fuse 402, mated contacts 410, 411 of relay CR1, mated contacts of relay CR5 hereinafter described, the price board movable arm 427 of the coin mechanism 428, the winding of unlatch solenoid 423', contacts 430, 423, contacts 426, 425 (engaged on energization of relay CR1 on closure of switch 348 as previously described) lead 426', lead 406, contacts 407, 408 and terminal 409. When the unlatch solenoid 423' is energized in the circuit just described, contact 423 transfers from contact 430 to 422 to energize the dog solenoid 364 in the circuit previously described. It will thus be apparent that the latching levers 362 and 362' in FIGS. 11 and 12 will not be unlatched by the dog solenoid 364 until the correct amount of coins have been deposited in the basic unit to energize the unlatch solenoid 423'. In other words, the described circuits are not operative until relay CR1 is first energized, on initially pulling an ejector in the satellite unit forward and the correct amount of coins is deposited in the basic unit to complete the circuit including the price board and the coin mechanism 428. The dog solenoid 364 is only thereafter energized, in the circuit previously described, to release the ejector for full forward movement thereof.

In the course of full forward movement of the satellite ejector, contacts 440 and 441 of switch 354 mate completing a circuit to a latching relay CR2, the circuit comprising terminal 400, fuse 402, contacts 410, 411, lead 414, mating contacts of relay CR5, lead 442, mating contacts 440, 441 (which mate on closure of switch 354 on pulling the satellite ejector forward) lead 443, contacts 444 and 445 of relay CR2, the winding of latch relay CR2, lead 446, contacts 416, 415, lead 421, contacts 422 and 423, lead 424, contacts 426 and 425, lead 426', lead 406, contacts 407 and 408 to termainal 409 of the power source.

When latching relay CR2 is energized, its contact 447 transfers to contact 448 completing a circuit for energization of relay CR4 from terminal 400, fuse 402, contacts 410, 411 of relay CR1, lead 414, the closed contacts of relay CR5, lead 449, the winding of relay CR4, lead 450, contacts 448 and 447 (which mated on energization of latch relay CR2) contacts 422, 423, lead 424, contacts 425, 426, lead 426', lead 406, contacts 407, 408 to terminal 409. Energization of relay CR4 transfers contact 451 for engagement with contact 452. Upon closure of contacts 451 and 452 the motor M in the basic unit is energized, the deposited coins are collected and credit in the coin mechanism accumulator is cancelled, these operations being well known to those skilled in the art and, in any event intrinsic to the operation of the basic unit as described in the Service Manual Parts Catalogue previously referred to. Suffice it to say that upon energization of relay CR4 and transfer of its contact 451 into engagement with contact 452 a circuit to the motor is completed, the circuit comprising terminal 400, fuse 402, lead 403, winding of motor M, lead 453, contacts 452, 451 (which closed on energizing relay CR4) lead 421, contacts 422, 423, lead 424, contacts 426, 425 of relay CR1, lead 426', lead 406, contacts 407, 408 to terminal 409 of the power source.

It should be noted that with the closure of contacts 451 and 452 of relay CR4 a circuit is also established for relay CR3 from terminal 400 of the power source 401, fuse 402, lead 403, the winding of relay CR3, contacts 452 and 451, lead 421, contacts 422, 423, lead 424, contacts 426, 425, lead 426', lead 406, contacts 407 and 408 to terminal 409 of the power source. It will be appreciated that relay CR3 is energized only after the contacts 440, 441 of switch 354 engage and after relays CR2 and CR4 are energized. Upon energization of relay CR3 its contacts 419 and 453' engage to break the circuit for the dog solenoid 364, in consequence of which lever 362 will again block movement of the ejector when it is returned to its rearward normal position.

We provide an additional switch pole for relay CR4 having contacts 454, 455 and 456 to lock out empty sensing solenoid 454' and the series connected flap switches in the basic unit when an ejector in the satellite unit is operated. It will be seen in FIG. 14, when relay CR4 is energized; i.e. when its contacts 455 and 456 engage, the circuit to the empty sensing solenoid is broken. This occurs, as explained, when an ejector in the satellite unit is operated. If a push-button switch in the basic unit is operated, a circuit is provided through contacts 410, 412 and 454',455 which includes the empty sensing solenoid 454. If a magazine compartment has been depleted of cigarette packs, solenoid 454 is energized in that circuit so that deposited coins will not be collected.

The satellite unit in the embodiment disclosed does not utilize the empty sensing solenoid circuit and incorporates instead suitable empty locks (not shown) on the satellite ejector heads for locking any ejector out of operation when the respective front magazine compartment is emptied. Such locks are disclosed in U.S. Pat. No. 2,823,782, the disclosure of which is incorporated herein.

A relay CR5 is provided to prevent completion of the circuit including the coin mechanism, and thereby the circuit including the dog solenoid 364, when the coin return switch 457 is manually operated for return of deposited coins. The relay is energized when the following circuit is completed: terminal 400 of the power source, lead 458, the winding of relay CR5, contacts 459, 460 of switch 457, lead 406, contacts 407, 408 to terminal 409 of the power source. When relay CR5 is thus energized, its contacts 461, 462 engage to break the circuits including the price board and coin mechanism on the one hand, and relays CR2 and CR4 on the other hand.

As indicated, the electrical circuit in the basic unit operates normally when a push-button selector switch is operated in the basic unit. Also it will be appreciated from the foregoing disclosure, once relay CR4 is energized (upon closure of switch 354 and upon energization of relay CR2 both of which occur on operating a satellite ejector) excepting for the circuit including the empty sensing solenoid 454', the satelite unit operates with the same electrical circuits as does the basic unit when one of its push button selector switches is operated. Hence, the following disclosure applies to both the satelite and the basic vending units.

The coin mechanism in the basic unit adds the coins deposited therein and establishes a credit for the money thus deposited. When the amount of the coins so deposited corresponds to the price board setting for the article selected the circuit to the motor M is closed (for the basic unit in normal manner and for the satelite unit as previously disclosed). When the motor is thus energized, it drives, as well known, motor carriage means 463 to collect the coins and to cancel the credit in the coin mechanism. Movement of the carriage means, on energizing the motor, also causes motor contact 408 to engage contact 464 thereby directly operating the motor from the power source. Additionally, when a basic unit ejector is operated (on depression of a push-button selector which occurs immediately after the coins are deposited) the motor carriage means delivers the article selected in the basic unit. It will be understood that no article is delivered by the carriage means when a satellite ejector is operated since the article thus selected is delivered from the satellite unit magazine and not the basic unit magazine. In any case, if an ejector in the basic unit is operated, the empty sensing solenoid 454' (and cooperating series connected flap switches) is operative during each delivery cycle when energized to prevent collection of the deposited coins if the magazine compartment is empty and to ensure collection of the deposited coins if the solenoid is not energized as would occur on dispensing a selected article past the flap switches. The delivery cycle is completed when the carriage means is returned to its inoperative position at which time the motor circuit is broken by movement of contact 408 into engagement with contact 407 and by movement of contact 423 from contact 422, into engagement with contact 430. Contact 408 is moved into contact with contact 464 upon movement of a carriage arm 463' from its inoperative position (shown in FIG. 14) which occurs when the motor is energized. It will thus be appreciated that once the motor is energized in the circuit previously described, because contact 408 transfers to contact 464 the motor will continue to be energized directly from the power source and no longer through the coin return switch 457, contacts 425 and 426 of relay CR1 and/or contacts 451, 452 of relay CR4. This permits relay CR1 to drop out before the delivery cycle ends; i.e. before the carriage arm 463 urges contact 408 into engagement with contact 407 ending the delivery cycle. Relay CR1 drops out when the operated ejector is returned to its retracted position which as will be appreciated occurs before delivery cycle ends. Engagement of contacts 464 and 408 upon initiating motor operation, ensures therefore continued motor operation after relay CR1 drops out (which occurs when contact 404 is separated from contact 405 upon completion of rearward movement of the satellite ejector). If the delivery cycle in the basic unit were prematurely terminated on operating a satellite unit ejector, the carriage means would not be returned to its inoperative position so that if, subsequent to operation of the the satellite unit, it is desired to operate the basic unit, this would not be possible. Also, it is to be noted that relay CR3 remains energized when contact 408 energizes contact 464 on motor operation and will remain energized until the end of the delivery cycle thereby preventing energization of the dog solenoid 364 as might occur on engagement of contacts 415, 416 which could happen if the satellite ejector were pulled forward far enough to close switch 348. By maintaining contact 419 in engagement with contact 453', as would occur during energization of relay CR3, the dog solenoid 364 will not be energized even if relay CR1 is, is thereby preventing, pulling forward of the satellite ejector again until the cycle is completed.

A motor controlled cam element 465, on initiating motor operation, urges contact 466 from contact 467 and transfers it into engagement with contact 468. This completes a holding circuit for relay CR2, the circuit comprising terminal 400, fuse 402, lead 403, lead 469, contacts 466, 468, contacts 445, 470 of relay CR2, the winding of relay CR2, contacts 451, 452 of relay CR4, lead 453, contacts 408, 464 to terminal 409. It will be understood that on energizing a circuit for relays CR1, CR2, and CR4 will be maintained when contacts 407 and 408 separate on motor operation, the return for these relays being through contacts 451 and 452 of relay CR4, lead 453, contacts 464, 408 to terminal 409 of the power source. Upon deenergization of relay CR1 (on movement of the satellite ejector to its fully retracted position) contact 410 of relay CR1 again engages contact 412 thereof to enable operation of the basic unit after completion of the motor cycle. Upon completion of the motor cycle, cam 465 returns contact 466 into engagement with contact 467 thus breaking the energizing circuit for relay CR2 which thereupon transfers its contact 447 into engagement with contact 448 thereby breaking the energizing circuit for relay CR4. Relay CR3 also drops out on completion of the motor cycle and returns contact 419 into engagement with contact 418.

As to the ejectors of the basic unit, suffice it to say that when a push button switch in the basic unit is operated, a circuit is completed through a corresponding pack pusher solenoid 413, contacts of the price board, the movable arm 427 of the coin mechanism, the unlatch solenoid 423', the motor switch, the coin return switch 457 and the motor by-pass switch (having contacts 407, 408 and 464). This energizes the associated pack pusher solenoid for the selected compartment and the unlatch solenoid 423 of the coin mechanism. The pack pusher or cradle is raised and latched in place and a plunger (not shown) of the unlatch solenoid 423' releases a coin return locking latch (not shown) to prevent operation of the coin return mechanism during a purchase. It is the motion of the coin return lock which releases the contact 423 for movement by the unlatch solenoid 423' into engagement with contact 422 to break the circuit to the selector switches and to close the motor circuit as previously described. Because the push-buttons for the selector switches are connected in series, electrical operation of one selector button prevents electrical operation of all other buttons. This is ensured, as known, by a locking slide arrangement which prevents completion of the electric circuits of all but the selected button. When the motor cycle is completed, as a function thereof, contact 408 again engages contact 407 and contact 423 is brought into engagement with contact 430.

Relays CR1, CR2, CR3, CR4 and CR5 and their associated switches are preferably provided in the satellite unit. However, it will readily be apparent that these relays could also be located in the basic existing unit for wiring into the electrical circuitry therein. Switches 348 and 354 and the dog solenoid 364 are provided in the satellite unit.

It will be seen from the foregoing that the various objectives of our invention have been achieved. Since various changes can be made in the disclosed constructions without departing from the scope of the invention, it is intended that what has been disclosed be viewed as illustrative and that the scope of the invention be determined by the appended claims.

What we claim is:

1. The combination of a first vending machine with a second vending machine having a cabinet and therewithin a coin mechanism, said first vending machine comprising (a) a frame within a cabinet attached atop the cabinet of said second machine, (b) an article storing assembly carried by said frame and defining a plurality of compartments for storing articles to be dispensed, (c) a plurality of pull-out ejector means for predeterminedly positioning and for ejecting positioned articles from said compartments on pull-out movement of said ejector means from a normal rest position and return thereto, respectively, (d) means operatively interconnecting said pull-out ejector means in said first machine with said coin mechanism in the second machine for enabling pull-out movement of said ejector means in the first machine under control of the coin mechanism in the second machine and for clearing said coin mechanism incident to pull-out movement of said ejector means whereby to dispense articles from the first machine as a function of coin deposit in the second machine, and (e) means for returning said pull-out ejector means to its normal rest position for dispensing selected articles.

2. A first vending machine connected with a second vending machine having a cabinet provided with coin slot means for receiving coins and within the cabinet a coin mechanism, operated by coins deposited within said coin slot means, and a manually, selectively operable, article dispensing mechanism for dispensing stored articles from said second machine, said first machine comprising a cabinet attached atop the cabinet of the second machine, a frame within and attached to the first machine cabinet, an article storing assembly carried by said frame and defining a plurality of compartments for storing articles to be dispensed, a plurality of pull-out ejector means for predeterminedly positioning and for ejecting positioned articles from said compartments on pull-out movement of said ejector means from a normal rest position and return thereto, respectively, means connecting said pull-out ejector means in the first machine with said coin and article dispensing mechanism in said second vending machine (a) for enabling pull-out movement of the ejector means in the first machine under control of the coin mechanism in the second machine, (b) for locking out the article dispensing mechanism of said second machine when a pull-out ejector means in said first machine is operated and (c) for clearing said coin mechanism for subsequent coin deposits, and means for returning said pull-out ejector means to its normal rest position for dispensing selected articles.

3. In combination with a first vending machine having a cabinet, a coin mechanism therewithin, and coin slot means in the cabinet for receiving coins for operating the coin mechanism, a second vending machine having (a) a cabinet mounted on and attached to the top of the first vending machine, (b) a frame within and attached to said second machine, (c) an article storing assembly carried by said frame, (d) a plurality of pull-out ejector means for predeterminedly positioning and for ejecting positioned articles from said compartments on pull-out movement of said ejector means from a normal rest position and return thereto, respectively, (e) means interconnecting said pull-out ejector means in the second vending machine with the coin mechanism in the first machine for enabling dispensing, pull-out, movement of said ejector means in the machine only when a predetermined amount of coins is deposited in said coin slot means in the first vending machine, and (f) means for returning said pull-out ejector means to its normal rest position for dispensing selected articles.

4. Apparatus for vending articles utilizing a coin mechanism of a first vending unit having at least one tier of magazines with ejectors and a shaft which rotates when one of said ejectors is operated, said apparatus including a satellite vending unit attached atop said first vending unit, said satellite unit having a plurality of magazines and a plurality of pull-out ejectors movable between first pulled-out, and second, normal rest, positions, and linkage means operatively connecting the pull-out ejectors of the satellite vending unit to the rotary shaft in said first unit for rotating the shaft in one direction when a pull-out ejector in the satellite unit is moved to its first position, enabled by deposit of the correct amount of coins in the coin mechanism of the first unit, and for rotating the shaft in an opposite direction when said pull-out ejector is moved to its second position, thereby to clear the coin mechanism for subsequent operation, and means for returning said pull-out ejectors to their normal rest position for dispensing articles stored in said magazines.

5. Apparatus according to claim 4, including means for locking out the ejectors of the first vending unit when a pull-out ejector in the satellite unit is operated, and means for locking out the ejectors of the satellite vending unit when an ejector of the first vending unit is operated.

6. The apparatus according to claim 5, wherein said means for operatively connecting said ejector of the satellite vending unit to the rotatable shaft include means in the satellite unit for converting reciprocating movement of the satellite ejectors to rotary motion and means for reconverting said rotary motion to reciprocating motion, said connecting means including in the first vending machine reciprocable slide means operatively connected to said reconverting means for rotating said shaft during its reciprocation of the slide means.

7. The apparatus according to claim 6, wherein said lock-out means in the first vending unit comprises at least one selector bar having one fixed end and a free end which is permitted to move laterally, and a pivotally mounted blocking means positioned in the first vending unit in the path of said movable slide means for movement thereby into engagement with said selector bar on operating an ejector in the satellite unit.

8. The apparatus according to claim 6, wherein said lock-out means for the satellite unit includes at least one selector bar in the first vending unit having a plurality of tumblers with one fixed end tumbler and one free end tumbler, said tumblers being movable laterally when an ejector in said first unit is operated, a blocking member disposed relative to said selector bar for engagement thereby when an ejector in the first unit is operated, said lock-out means including said movable slide means disposed in confronting relation to said blocking member and being blocked against movement thereby when the blocking member is engaged by said selector bar.

9. The apparatus according to claim 2, wherein said second vending machine dispensing mechanism includes at least one tier of storage columns with pull-out ejector means and a shaft rotatable by the operation of said second machine pull-out ejector means to clear said coin mechanism, said connecting means for connecting said first vending machine pull-out ejector means with the coin and article dispensing mechanism in said second vending machine comprising linkage means operatively connecting the pull-out ejector means of said first vending machine to the rotatable shaft of said second vending machine to rotate the shaft in opposed directions during reciprocating motion of the pull-out ejector means of the first machine to clear said coin mechanism, means for locking out the pull-out ejectors of said first vending machine when a pull-out ejector means in said second vending machine is operated, and means for locking out the ejectors in the second vending machine when an ejector in the first vending machine is operated.

10. The apparatus according to claim 9, wherein the linkage means in said first vending machine includes a slotted member which receives in a pin operatively connected to said first vending ejector means for reciprocation therewith, said linkage means including in said second vending machine slide means operatively connected with said slotted member by rod means extending between and into both said machines.

11. Apparatus according to claim 10, wherein said ejector means in the first vending machine carries a dog for reciprocating movement therewith, a ratchet being disposed with its teeth in the path of movement of the dog to prevent reverse movement of the ejector means, once the dog is in engagement with the ratchet teeth, until the dog clears said teeth.

12. Apparatus according to claim 10, wherein for moving said slide means by said rod means in a direction generally parallel to the path of movement of the ejector means in the second vending machine, said linkage means includes in the second vending machine, an intermediate plate member interconnected between said rod means and said slide means.

13. Apparatus according to claim 10, wherein for moving said slide means in a direction generally transverse to the movement of the ejector means in the second vending machine, the rod means is directly connected to the slide means.

14. Apparatus according to claim 2, wherein said second machine dispensing mechanism includes a plurality of storage columns for carrying a plurality of articles to be dispensed, ejector means for removing the articles from said columns, and electrical circuitry for energizing selected ejector means when the correct amount of coins are deposited in said coin mechanism and for de-energizing said ejector means and clearing said coin mechanism when an article has been dispensed, said connecting means for connecting said ejector means of said first vending machine with said coin and article dispensing mechanism in said second vending machine including first lock-out means in said first vending machine for preventing the pull-out ejector means in said first vending machine from being pulled outwardly from its normal rest position when an ejector means in the second machine is operated, and electrical circuit means in said first vending machine connected to said electrical circuitry in said second vending machine for receiving a signal from said electrical circuitry in said second vending machine when the correct amount of coins have been deposited in its coin mechanism for (a) disabling said first lock-out means to enable operation of a pull-out ejector means in said first vending machine, (b) de-energizing said ejector means in said second vending machine and (c) clearing said coin mechanism in the second machine upon operating the first vending machine.

15. Apparatus according to claim 14, wherein said first lock-out means includes a rotatable first lever means having one end pivotally secured to said frame of said first vending machine and the other end in normal latching relation to the first vending machine pull-out ejector means, and electrically operated means for unlatching said lever means to permit pull-out movement of the ejector means in the first machine upon completing a circuit including the coin mechanism in the second machine, which circuit is completed on deposit of the correct amount of coins in the second machine.

16. Apparatus according to claim 15, wherein said electrical circuit means for said first vending machine includes a first switch means in said first vending machine disposed for engagement by said ejector means in the normal rest position thereof, to open the contacts thereof, said contacts of said first switch being closed on moving said ejector means in said first vending unit from its normal rest to its pull-out operated position, said electrical means further including a solenoid secured to said first vending machine frame and having its core attached to said first lever means, said solenoid when energized unlatching said lever means from said ejector means in the first machine to permit operation of said ejector means.

17. Apparatus according to claim 16, wherein said circuit means additionally includes means operated under control of said switch means to disconnect, upon operating an ejector means in the first machine, said ejector means in said second vending machine from said coin mechanism and to operatively connect thereto for control thereby the ejector means of the first vending machine.

18. The apparatus according to claim 17, including a second switch which is closed by the operation of said ejector means in said first vending machine and being connected in said electrical circuitry in said second vending machine to initiate a full ejection cycle.

19. The apparatus according to claim 5, wherein said means for connecting said ejector means of the satellite vending unit to the rotary shaft in said first unit include linkage means for producing a first rotary motion from the reciprocating motion of the auxiliary vending unit ejectors, means for converting the rotary motion to a reciprocating motion, and slide means operatively connected to said converting means and to said shaft for rotating said shaft to clear said coin mechanism when said ejectors in said satellite vending unit are operated.

20. The apparatus of claim 6, wherein the first vending unit has a price differential linkage, said satellite vending unit having a linkage interconnected with said first vending unit for operating the pirce differential linkage of the first vending unit under control of a satellite unit ejector.

21. A satellite vending machine comprising a frame, an article storing assembly connected to said frame and defining a plurality of compartments for storing articles to be dispensed, pull-out ejector means movable from a first retracted to a second protracted position for ejecting articles from said compartments, means for normally latching said pull-out ejector means against full protracted movement to its second position but allowing limited movement thereof from its first position, switch means positioned relative to said pull-out ejector means for closure of its contacts during said limited movement of said ejector means from its retracted to a limited protracted position, and solenoid means adapted for energization on closure of the contacts of said switch means for moving the latch means free of the pull-out ejector means to permit full protraction thereof.

22. A first vending unit connected within a second vending unit having ejector means for ejecting articles to be dispensed and electrical circuitry for energizing selected ejector means when the correct coin amount is deposited in the coin mechanism, said circuitry being effective to deenergize said ejector means and to clear said coin mechanism when an article has been dispensed, said first unit including normally latched ejector means enabling partial operation of said ejector means, switch means connected in the electrical circuitry of the second unit and positioned proximate said ejector means, which on said partial operation thereof, actuates said switch means, first electrically operated means connected with the electrical cicuitry of the second unit and effective on closure of said switch means in the first unit to disconnect the coin mechanism from the ejector means in the second unit and for instead controlling operation thereby of the ejector means in the first unit, and second electrically operated means in said first unit connected into the electrical circuitry of the second unit for unlatching the ejector means in the first unit on deposit of the correct coin amount in the coin mechanism of the second unit to permit complete operational movement of the ejector means.

23. Apparatus according to claim 22, wherein the electrical circuitry in the second unit includes a motor therein, third electrically operated means being provided in said first unit proximate said ejector means thereof and connected into the electrical circuitry of the second unit for starting a cycle of motor operation in the second unit to clear the coin mechanism.

24. Apparatus according to claim 23, wherein the first electrically operated means is a relay, said second operated means is a solenoid and said third electrically operated means is a second switch.

25. Apparatus according to claim 24, wherein a second relay is provided in the first unit and connected into the electrical circuitry of the second unit to prevent operation of the ejector means therein upon operating a coin return switch in the second unit.

26. Apparatus according to claim 25, wherein a third relay is provided in the first unit and interconnected into the electrical circuitry of the second unit for deenergizing said solenoid at the end of the cycle of the motor operation.

27. The combination of a first vending machine with a second vending machine having a cabinet and therewithin a coin mechanism, said first vending machine comprising (a) a frame within a cabinet attached atop the cabinet of said second machine, (b) an article storing assembly carried by said frame and defining a plurality of compartments for storing articles to be dispensed, (c) a plurality of pull-out ejector means for predeterminedly positioning and for ejecting positioned articles from said compartments on pull-out movement of said ejector means from a normal rest position and return thereto, respectively, said plurality of pull-out ejector means each comprising an elongate member provided with a knob at its front end and with an ejector head at its rear end, which ejector head in its normal rest position underlies the stored articles the lowermost of which is positioned for dispensing from the first machine on pull-out movement of an ejector means thereof, said lowermost article thus positioned being dispensed from the machine by said ejector head on return movement of the relevant ejector means to its normal rest position, (d) means operatively interconnecting said pull-out ejector means in said first machine with said coin mechanism in the second machine for enabling pull-out movement of said ejector means in the first machine under control of the coin mechanism in the second machine and for clearing said coin mechanism incident to pull-out movement of said ejector means whereby to dispense articles from the first machine as a function of coin deposit in the second machine, and (e) means for returning said pull-out ejector means to its normal rest position for dispensing selected articles.

28. A first vending machine connected with a second vending machine having a cabinet provided with coin slot means for receiving coins and within the cabinet a coin mechanism, operated by coins deposited within said coin slot means, and a manually, selectively operable, article dispensing mechanism for dispensing stored articles from said second machine, said first machine comprising a cabinet attached atop the cabinet of the second machine, a frame within and attached to the first machine cabinet, an article storing assembly carried by said frame and defining a plurality of compartments for storing articles to be dispensed, a plurality of pull-out ejector means for predetermining positioning and for ejecting positioned articles from said compartments on pull-out movement of said ejector means from a normal rest position and return thereto, respectively, said plurality of pull-out ejector means each comprising an elongate member provided with a manually grippable knob at its front end and with an ejector head at its rear end, which ejector head in its normal rest position underlies the stored articles the lowermost of which is positioned for dispensing from the first machine on pull-out movement of an ejector means thereof, said lowermost article thus positioned being dispensed from the machine by said ejector head on return movement of the relevant ejector means to its normal rest position, means connecting said pull-out ejector means in the first machine with said coin and article dispensing mechanisms in said second vending machine (a) for enabling pull-out movement of the ejector means in the first machine under control of the coin mechanism in the second machine, (b) for locking out the article dispensing mechanism of said second machine when a pull-out ejector means in said first machine is operated and (c) for clearing said coin mechanism for subsequent coin deposits, and means for returning said pull-out ejector means to its normal position for dispensing selected articles.

29. In combination with a first vending machine having a cabinet, a coin mechanism therewithin, and coin slot means in the cabinet for receiving coins for operating the coin mechanism, a second vending machine having (a) a cabinet mounted on and attached to the first vending machine, (b) a frame within and attached to said second machine, (c) an article storing assembly carried by said frame, (d) a plurality of pull-out ejector means for predeterminedly positioning and for ejecting articles from said compartment on pull-out ejector means for predeterminedly positioning and for ejecting articles from said compartment on pull-out movement of said ejector means from a normal rest position and return thereto, respectively, said plurality of pull-out ejector means comprising an elongate member provided with a knob at its front end and with an ejector head at its rear end, which ejector head in its normal rest position underlies the stored articles the lowermost of which is positioned for dispensing from the second machine on pull-out movement of an ejector means thereof, said lowermost article thus positioned being dispensed from the machine by said ejector head on return movement of the relevant ejector means to its normal rest position, (e) means interconnecting said pull-out ejector means in the second vending machine with the coin mechanism in the first machine for enabling dispensing pull-out movement of said ejector means in the second machine only when a predetermined amount of coins is deposited in said coin slot slot means in the first vending machine, and (f) means for returning said pull-out ejector means to its normal rest position for dispensing selected articles.

30. Apparatus for vending articles utilizing a coin mechanism of a first vending unit having at least one tier of magazines with ejectors and a shaft which rotates when one of said ejectors is operated, said apparatus including a satellite vending unit attached atop said first vending unit, said satellite unit having a plurality of magazines and a plurality of pull-out ejectors movable between first pull-out, and second, normal rest, positions, said pull-out ejectors each comprising an elongate member provided with a knob at its front end and with an ejector head at its rear end, which ejector head in its normal rest position underlies articles stored in the magazines of the satellite vending unit, the lowermost stored article being positioned for dispensing from the satellite vending unit on pull-out movement of an ejector thereof, said lowermost article thus positioned being dispensed from the machine by said ejector head on return movement of the relevant ejector to its normal rest position, linkage means operatively connecting the pull-out ejectors of the satellite vending unit to the rotary shaft in said first unit for rotating the shaft in one direction when a pull-out ejector in the satellite unit is moved to its first position, enabled by deposit of the correct amount of coins in the coin mechanism of the first unit, and for rotating the shaft in an opposite direction when said pull-out ejector is moved to its second position, thereby to clear the coin mechanism for subsequent operation, and means for returning said pull-out ejectors from their first pull-out positions to said second, normal rest, positions thereof.

* * * * *